US006198900B1

(12) United States Patent
Wakahara

(10) Patent No.: US 6,198,900 B1
(45) Date of Patent: Mar. 6, 2001

(54) CHARGE SUPPLY DEVICE FOR CHARGING BODIES IN IMAGE FORMING APPARATUS AND THE LIKE

(75) Inventor: Shirou Wakahara, Chiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/243,926

(22) Filed: Feb. 3, 1999

(30) Foreign Application Priority Data

Feb. 3, 1998 (JP) ..... 10-022407
Dec. 28, 1998 (JP) ..... 10-372125

(51) Int. Cl.[7] ..... G03G 15/16
(52) U.S. Cl. ..... 399/313; 399/312
(58) Field of Search ..... 399/313, 66, 96, 399/121, 297, 310, 315, 223

(56) References Cited

U.S. PATENT DOCUMENTS 5,241,343 * 8/1993 Nishio ..... 399/90
5,963,763 * 10/1999 Kabai et al. ..... 399/223

FOREIGN PATENT DOCUMENTS 49-24139 3/1974 (JP) .
04101181 4/1992 (JP) .
4-291374 * 10/1992 (JP) .
4-429137 * 10/1992 (JP) .

* cited by examiner

*Primary Examiner*—Quana M. Grainger
(74) *Attorney, Agent, or Firm*—Dike, Bronstein, Roberts & Cushman, LLP; David G. Conlin; David A. Tucker

(57) ABSTRACT

A region with high resistance equal to the atmosphere is provided in a transfer roller. A discharge electrode capable of performing discharge between a base member and the discharge electrode is arranged within the region. When a predetermined electric potential is applied to the discharge electrode from a transfer power supply, the electric potential is separated and respectively applied to a first region in the transfer roller and a second region between the transfer roller and a photosensitive drum. At this time, since both the first and second regions are regions of high resistance, the electric potential applied to each region is equal, and therefore the electric field can never be concentrated in the second region. Moreover, since a predetermined electric field is formed in the first region, even when the transfer roller and photosensitive drum come into contact with each other, a transfer current can never collect in the contact. Thus, when a high electric potential is applied to the transfer roller, it is possible to avoid toner from unpreparedly flying from the photosensitive drum to paper, and prevent concentration of the transfer current in a region between the transfer roller and photosensitive drum, where the paper is not present.

28 Claims, 15 Drawing Sheets

CHARGE SUPPLY DEVICE FOR CHARGING BODIES IN IMAGE FORMING APPARATUS AND THE LIKE

FIELD OF THE INVENTION

The present invention relates to image forming apparatuses including transfer means for transferring a toner image formed on a photosensitive body onto a recording medium, and/or charging means for charging the photosensitive body, for use in the printing section of digital copying machines and facsimile machines, digital printers, plotters, etc., and also relates to charge supply devices suitable for use as, for example, the transfer means and the charging means.

BACKGROUND OF THE INVENTION

Various types of image forming apparatuses for forming an image on a recording medium on the basis of an electrostatic latent image (charge pattern) formed on a photosensitive body, have been conventionally proposed. Among the proposed apparatuses, for example, an image forming apparatus disclosed in Japanese Laid-open Patent Application (Tokukaisho) No. 49-24139/1974 adopts a so-called electrostatic transfer system of developing an electrostatic latent image after transferring the electrostatic latent image formed on a photosensitive body to a recording medium by transfer means. The following description will explain this image forming apparatus.

As illustrated in FIG. 13, the image forming apparatus of this document includes a photosensitive body 101 for carrying an electrostatic latent image thereon. The photosensitive body 101 is formed by three layers, namely, a high insulating layer 101*a*, photoconductive layer 101*b*, and electrode layer 101*c*, arranged in this order from the outer side.

Disposed around the photosensitive body 101 is a primary corona discharger 102 for charging the surface of the photosensitive body 101 by applying a voltage of a predetermined polarity to the surface of the photosensitive body 101 by corona discharge, a secondary corona discharger 103 for charging the surface of the photosensitive body 101 by applying a voltage of the opposite polarity to that of the voltage applied by the primary corona discharger 102, to the surface of the photosensitive body 101 by corona discharge, and an entire-surface exposing light source 104.

With the use of the first corona discharger 102 and secondary corona discharger 103 which are not in contact with the photosensitive body 101 as means for charging the photosensitive body 101, it is possible to prevent movement of charges on the surface of the photosensitive body 101 and lowering of the strength of an electrostatic latent image due to the movement of charges, which occur in a structure where the surface of the photosensitive body 101 is charged by bringing the electrode into contact with the photosensitive body 101.

A transfer section 105 is provided on the downstream side of the entire-surface exposing light source 104, in a rotating direction (clockwise direction in FIG. 13) of the photosensitive body 101. The transfer section 105 includes a transfer belt 106 pressed against the photosensitive body 101 via a transfer sheet 110, and two transfer rollers 107*a*, 107*b* for stretching the transfer belt 106 therebetween. Provided on the sheet feeding side of the transfer section 105 are feed rollers 108*a*, 108*b* for transporting the transfer sheet 110 to the transfer section 105 while sandwiching the transfer sheet 110 therebetween. On the other hand, provided on the sheet output side of the transfer section 105 are feed rollers 109*a*, 109*b* for outputting the transfer sheet 110 having an electrostatic latent image transferred thereto from the transfer section 105 and transporting the output transfer sheet 110 to a developing section (not shown) while sandwiching the transfer sheet 110 therebetween.

In this structure, when the surface of the photosensitive body 101 is uniformly charged in a predetermined polarity by the primary corona discharger 102, a light image is projected onto the photosensitive body 101 while applying a voltage of the opposite polarity by the secondary corona discharger 103, thereby forming on the highly insulating layer 101*a* of the photosensitive body 101 an electrostatic latent image corresponding to the light image. Subsequently, the surface of the highly insulating layer 101*a* is illuminated with a light beam from the entire-surface exposing light source 104 so as to release permanent internal polarization in the photoconductive layer 101*b*. As a result, the variation of charge in the photosensitive body 101 is stabilized immediately, and the electrostatic latent image formed according to the light image is stabilized.

Thereafter, the electrostatic latent image is transported to a transfer region between the photosensitive body 101 and the transfer belt 106 by a rotation of the photosensitive body 101, and transferred to the transfer sheet 110 transported to the transfer region by the transport rollers 108*a*, 108*b*, and the transfer belt 106. After separating the transfer sheet 110 from the photosensitive body 101, the transfer sheet 110 is output from the transfer section 105 by the transport rollers 109*a*, 109*b*, and transported to a developing section.

By the way, in such an image forming apparatus adopting the electrostatic transfer system, it is likely that distorted electrostatic latent image is transferred to the transfer sheet 110 due to non-uniformity of the contract pressure between the transfer belt 106 and photosensitive body 101, etc. As a result, variations in the strength of the transferred image on the transfer sheet 110 occur. Moreover, in the above-mentioned structure, since development is performed after the transfer of the electrostatic latent image to the transfer sheet 110, the transfer sheet 110 is likely to get dirty.

In resent years, therefore, development of image forming apparatuses adopting a development transfer system, in which an electrostatic latent image formed on a photosensitive body is developed into a visible image in advance on the photosensitive body with a developer such as toner and then the visible image is transferred to a recording medium, has been actively carried out.

However, in an image forming apparatus of typical structure employing the development transfer system, as illustrated in FIG. 14, for example, when a high electric potential is applied to a transfer roller 201 as transfer means so as to perform image formation at a high speed, toner 204 on a photosensitive body 203 flies toward a sheet 202, i.e., so-called scattering of toner 204 occurs, before the sheet 202 is transported to a transfer position between the transfer roller 201 and the photosensitive body 203 and comes into contact with the photosensitive body 203. As a result, the outline of the transferred toner image is blurred, and thus the image quality deteriorates. The following description will explain the theory of occurrence of the scattering of toner.

Here, it is assumed that a straight line OQ' connecting a center O of the rotation axis of the transport roller 201 and a point Q' at which scattering of the toner 204 occurs, the point Q' being located on the upstream side of a nip region of the surface of the photosensitive body 203 along a rotating direction (clockwise direction in FIG. 14) of the photosensitive body 203, is divided into two straight lines OP' and P'Q' by a point P' on the surface of the transfer roller 201, and regions including the straight lines OP' and P'Q' are denoted as region P and region Q, respectively.

Moreover, suppose that the lengths of the straight lines OP' and P'Q' are $d_p$ and $d_Q$, the electric potentials applied to the regions P and Q are $V_P$ and $V_Q$. and electric fields formed in the regions P and Q are considered to be formed along the straight lines OP' and P'Q' as shown in FIG. 14 and denoted by $E_p$ and $E_Q$, respectively, for simplification purposes, the electric fields $E_P$ and $E_Q$ are given by the lengths $d_p$ and $d_Q$ and the electric potentials $V_P$ and $V_Q$ as indicated below.

$$E_P=V_P/d_p$$

$$E_Q=V_Q/d_Q$$

By the way, supposing that the regions P and Q are arranged in series, the electric potentials applied to the regions P and Q are substantially proportional to the resistances in the regions P and Q, respectively. Here, the region Q is the atmosphere, and exhibits substantially a high resistance like an insulator, while the region P is formed by an elastic body, such as rubber, whose volume resistivity is, for example, around $10^7$ to $10^8$ Ω·cm. Specifically, the resistance is greater in the region Q than in the region P. Therefore, when a transfer electric potential is applied to the transfer roller 201 from a transfer power supply (not shown), most of the transfer electric potential is applied to the region Q. Namely, $V_P<<V_Q$.

As described above, when a high electric potential is applied to the transfer roller 201, the difference between $V_P$ and $V_Q$ is greater than the difference between $d_P$ and $d_Q$ on the upstream side of the nip region, and therefore $E_P<<E_Q$. As a result, the electric field $E_Q$ in the region Q becomes greater than a necessary value, and the toner 204 on the photosensitive body 203 flies toward the sheet 202 before the toner 204 reaches the nip region.

Besides, in the above-mentioned image forming apparatus, as illustrated in FIG. 15, when a sheet 202 of a small width like, for example, a post card, is used, the transfer roller 201 comes into contact with the photosensitive body 203 in a region where the sheet 202 is not present. In FIG. 15, a region R is a region of the photosensitive body 203, corresponding to the width of the sheet 202, while a region S substantially corresponds to the contact region to the transfer roller 201.

Hence, when a high electric potential is applied to the transfer roller 201 as mentioned above, most of the transfer electric potential applied to the transfer roller 201 is concentrated in the region S, a transfer current flows and is concentrated in the region S, and thus a sufficient transfer current cannot be obtained on the sheet 202. Consequently, a sufficient transfer cannot be achieved. Such a problem is more noticeable with an increase in the electric potential applied. Therefore, in practice, the image forming apparatus having the above-mentioned structure cannot be applied to high speed devices, for example, a business copying machine.

In addition, similarly to the above, when the charging means for charging the surface of the photosensitive body 203 is formed by a charging roller 205 made from an elastic body, for example, rubber, as shown in FIG. 17, such a phenomenon that the electric field $E_Q$ becomes greater than a necessary value with the application of high electric potential to the transfer roller 201 occurs between the charging roller 205 and the photosensitive body 203. This is due to the same reason as mentioned above that the resistance differs between the inside of the charging roller 205 and the outside (the region of atmosphere between the transfer roller 205 and the photosensitive body 203).

Hence, in FIG. 17, when a high electric potential is applied to the charging roller 205, discharge occurs in a region other than a usual discharge region. More specifically, supposing that a region U near the contact section T between the charging roller 205 and the photosensitive body 203 is the usual discharge region, discharge occurs in a region V which is more distant from the contact section T than the region U. The diameter of a discharge path decreases with an increase in the length of a discharge path between the charging roller 205 and the photosensitive body 203, the charging electric potential varies locally on the surface of the photosensitive body 203 in such a structure. As a result, a granular pattern resulting from the unevenness of the charging electric potential appears on a printed image.

Namely, if the transfer roller 201 and charging roller 205 are called a charge supply device for supplying charge to the photosensitive body 203 and if the photosensitive body 203 to which the charge is supplied is called a body to be charged, a high electric field is formed in a region between the charge supply device and the body to be charged, where the formation of electric field is not required, when a high electric potential is applied to the charge supply device from the power supply, etc. in the above-mentioned conventional structure. Consequently, satisfactory image formation cannot be carried out.

SUMMARY OF THE INVENTION

An object of the present invention is to provide a charge supply device capable of forming a suitable electric field between a body to be charged and the charge supply device by appropriately supplying charge to the body to be charged, and to provide an image forming apparatus capable of forming a good image by adopting the charge supply device.

In order to achieve the above object, a charge supply device of the present invention, which is disposed to face a body to be charged and supplies charge to the body to be charged, includes: a closed base member having therein a high resistant region with a resistance equal to atmosphere; and discharging means for generating charge by discharge and for forming, between the charge supply device and the body to be charged, an electric field capable of supplying the charge to the body to be charged, wherein the discharging means is disposed in the high resistant region.

With this structure, an electric field is formed between a region inside the charge supply device (hereinafter referred to as the first region) and also formed in a region between the charge supply device and the body to be charged (hereinafter referred to as the second region) by the discharge caused in the high resistant region in the closed base member by the discharging means. In particular, an electric field capable of supplying charge to the body to be charged is formed in the second region by the charge generated by the discharge.

Here, since the second region is originally a high resistant region formed in the atmosphere, the first and second regions have similar high resistance, and there is no extreme difference in resistance between those regions. Therefore, for instance, even if a high electric potential is applied to the charging means, fractions of the electric potential substantially proportional to the values of resistance are applied to the first and second regions, respectively. Therefore, the electric field can never be concentrated in especially the second region due to the difference in resistance between the first and second regions like a conventional structure. Hence, a high electric field can never be formed in a region between the charging means and the body to be charged, where the formation of an electric field is not originally required and the surfaces of the charging means and the body to be charged are separated by a certain distance.

Thus, with this structure, even when a high electric potential is applied to the charge supply device, it is possible to form a desired electric field in a desired region between the charge supply device and the body to be charged, and supply an appropriate amount of charge to the body to be charged.

Moreover, an image forming apparatus of the present invention includes charging means disposed to face the image carrier, and power supply means for producing a predetermined potential difference between the image carrier and charging means, and supplies charge from the charging means to the image carrier by causing discharge between the image carrier and charging means by the potential difference, wherein the charging means is constituted by the charge supply device.

The diameter of the discharge path between the charging means and the image carrier becomes smaller as the distance between the surfaces of the charging means and image carrier increases. However, in the above-mentioned structure, a discharge in the region where the formation of an electric field is not originally required and the surfaces of the charging means and image carrier are separated by a certain distance, is avoided. It is thus possible to prevent a discharge with a discharge path of a small diameter.

Accordingly, the electric potential on the surface of the image carrier does not vary locally. It is thus possible to prevent a granular pattern from being formed in an printed image due to the uneven charging of the image carrier, and form an image of good quality.

Furthermore, an image forming apparatus of the present invention includes: an image carrier for carrying a charge pattern corresponding to image information; developing means for developing the charge pattern into an image with developer; transfer means disposed to face the image carrier; and power supply means for producing a predetermined potential difference between the image carrier and transfer means, and transfers the image on the image carrier to a recording medium supplied between the image carrier and transfer means by the potential difference, wherein the transfer means is constituted by the charge supply device.

According to the above-mentioned structure, even when a high electric potential is applied to the transfer means, the transfer electric field can never be concentrated in the region between the transfer means and image carrier. Therefore, this structure can prevent the developer carried on the image carrier from unpreparedly flying to the transfer means in the above region. As a result, for example, when performing image formation at a high speed, it is possible to avoid blurring of the outline of the transferred image and a lowering of the contrast, thereby providing a good transferred image.

Meanwhile, in the conventional structure, the transfer electric field is concentrated in particularly the region when a high electric potential is applied to the transfer means. Therefore, for example, if a recording medium of a small width is used, the transfer electric field and the transfer current are likely to be concentrated in the region where the recording medium is not present and the image carrier and the transfer means are in contact with each other. However, in the above-mentioned structure, even when a high electric potential is applied to the transfer means, the transfer electric field and transfer current can never be concentrated in the contact region.

Thus, the above structure can prevent a shortage of the transfer current supplied for the transfer of the developer to the recording medium, and achieve a good transfer even when a recording paper of a small width is used. Additionally, in such a case, since there is no need to use a large-scale power supply means to avoid the shortage of the transfer current nor transfer means of a high resistance, it is possible to prevent an increase in the cost of the apparatus and reduce the size of the apparatus.

For a fuller understanding of the nature and advantages of the invention, reference should be made to the ensuing detailed description taken in conjunction with the accompanying drawings.

BRIEF DESCRIPTION OF THE DRAWINGS

FIG. 1(*b*) is a cross section of the transfer roller cut across a plane including the rotation axis.

FIG. 10(*b*) is a cross sectional view of a transfer section formed by a transfer roller, a tension roller, and a transfer belt stretched by these rollers.

DESCRIPTION OF THE PREFERRED EMBODIMENTS

Embodiment 1

Figure 1:
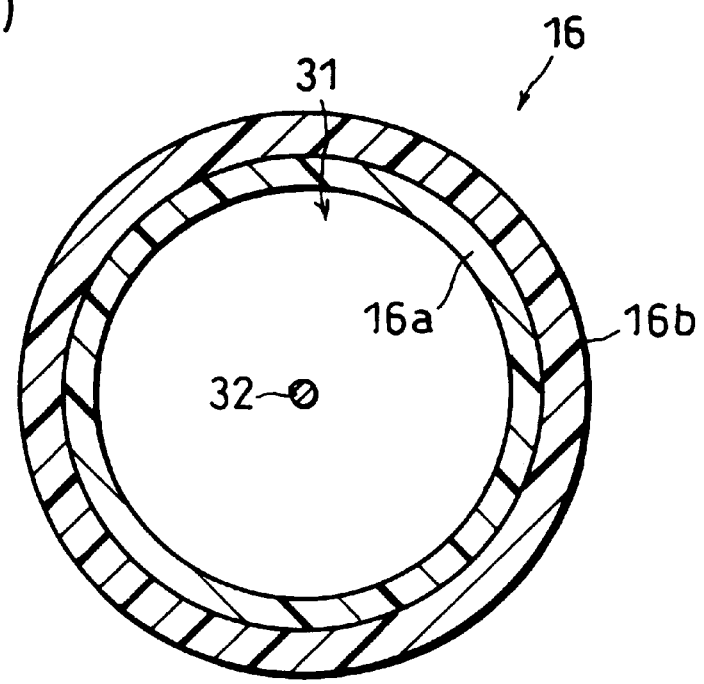
FIG. 1(*a*) is a view showing schematically a cross section of a transfer roller incorporated in an image forming apparatus according to one embodiment of the present invention, cut across a plane perpendicular to the rotation axis.
Figure 1:
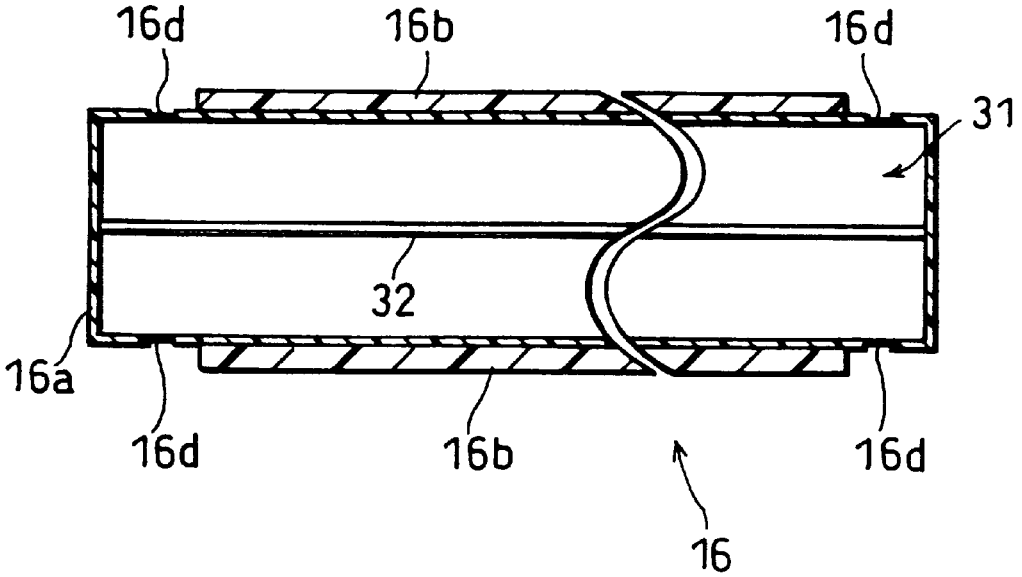
Figure 10A:
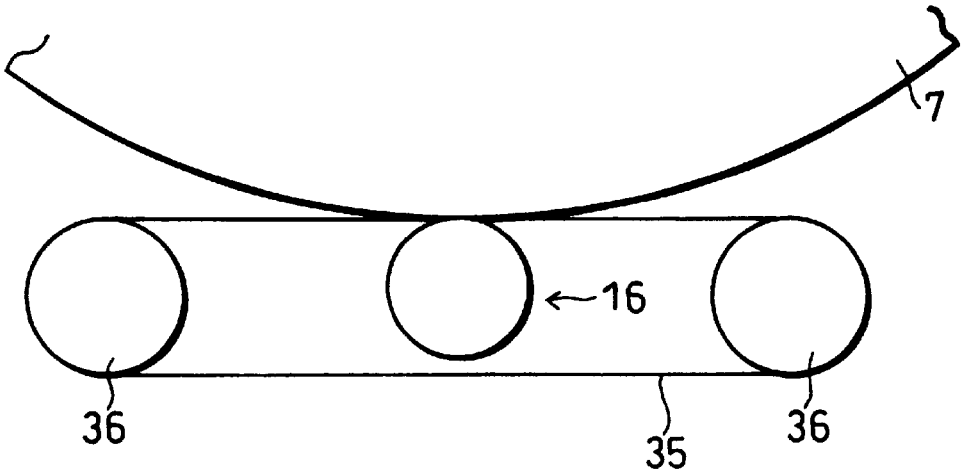
FIG. 10(*a*) is a cross sectional view of a transfer section formed by a transfer roller, a plurality of tension rollers, and a transfer belt stretched by the tension rollers.
Figure 10B:
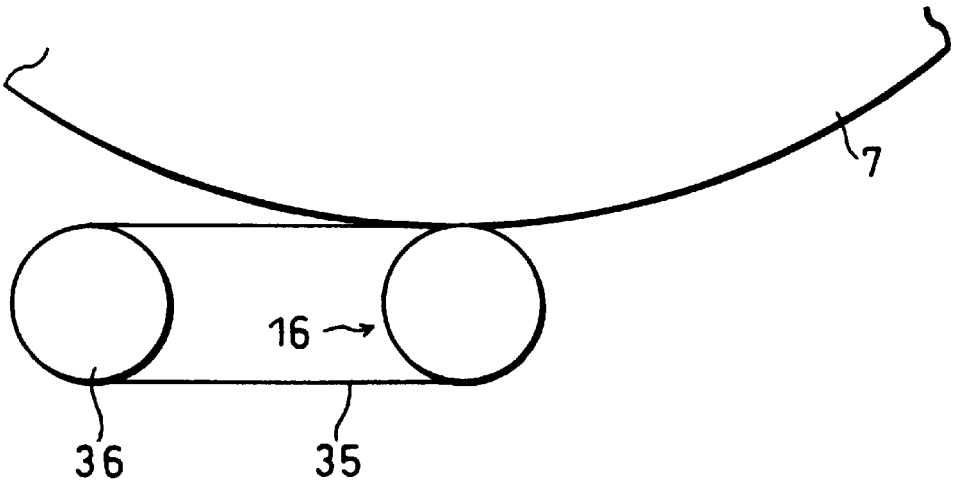

The following description will explain an embodiment of the present invention with reference to FIGS. 1(*a*), 1(*b*) to FIGS. 10(*a*), 10(*b*).

Figure 2:
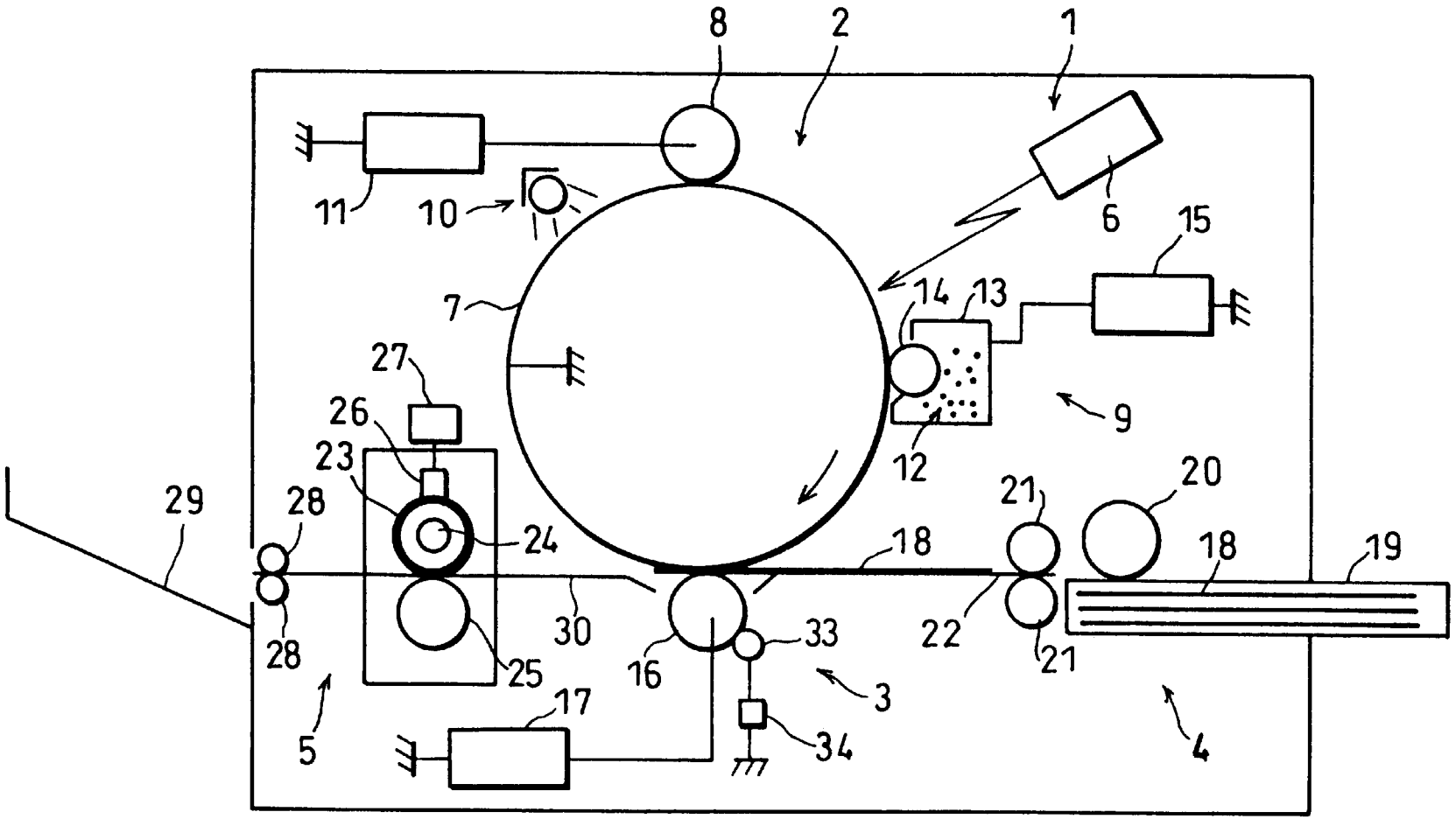
FIG. 2 is an explanatory view showing a schematic structure of the image forming apparatus.

As illustrated in FIG. 2, an image forming apparatus of this embodiment for printing an image in black and white, includes an exposure section 1, an image forming section 2, a transfer section 3, a paper feed section 4, and a fixing section 5.

The exposure section 1 includes a laser unit 6 for irradiating laser light on the surface of a charged photosensitive drum 7 (described later) on the basis of, for example, image signals from a computer (not shown) or image signals from an image processing section of a digital copying machine (not shown). The laser light emitted by the laser unit 6 irradiates the surface of the photosensitive drum 7, between a charging roller 8 and a developing section 9 (both are described later). Thus, the surface of the photosensitive drum 7 is exposed to the laser light, and an electrostatic latent image (a charge pattern formed by electrostatic charges) is formed on the photosensitive drum 7.

Here, the laser unit 6 can be constructed by, for example, an LED head composed of a plurality of light emitting diodes. Alternatively, the laser unit 6 can be, for example, an exposure device of an analog copying machine, which irradiates reflected light obtained by irradiation of a document, onto the photosensitive drum 7.

The image forming section 2 is formed by the photosensitive drum 7 (image carrying body), charging roller 8, developing section 9 (developing means), and a charge removing lamp 10. The charging roller 8, developing section 9, and charge removing lamp 10 are disposed on the periphery of the photosensitive drum 7, in this order along a rotating direction (clockwise direction in FIG. 2) of the photosensitive drum 7.

The photosensitive drum 7 is produced by placing a photosensitive layer on an aluminum pipe, and carries an electrostatic latent image corresponding to image information, formed thereon by the irradiation of laser light.

The charging roller 8 is produced by, for example, a solid rubber made of urethane as its base material, and has a volume resistivity of $10^6$ Ω·cm. The charging roller 8 is connected to a charging power supply 11, and supplies uniform charge to the surface of the grounded photosensitive drum 7. Therefore, the surface potential of the photosensitive drum 7 is maintained at, for example, −600 V.

The developing section 9 is formed by a toner tank 13 for storing toner 12 (developer), a sleeve 14 for imparting a predetermined characteristic to the toner 12 and for supplying the toner 12 to the photosensitive drum 7 with a rotation thereof, and a development bias power supply 15 for applying an electric potential for supplying the toner 12 to the photosensitive drum 7. The developing section 9 forms a toner image on the photosensitive drum 7 by developing an electrostatic latent image made of a charge pattern formed on the photosensitive drum 7, with the toner 12. Here, for the sake of simplifying explanation, it is assumed that the toner 12 is a negatively charged toner. However, in the case where the toner of the opposite polarity is used, the polarity of a voltage to be applied needs to be switched suitably.

The charge removing lamp 10 is formed by, for example, a plurality of light emitting diodes, and irradiates light on the surface of the photosensitive drum 7 so as to remove residual charge on the photosensitive drum 7 by neutralization.

A cleaning device (not shown) is provided on the upstream side of the charge removing lamp 10 along the rotating direction of the photosensitive drum 7 so that the toner remaining on the photosensitive drum 7 after a transfer of the toner image to a paper 18 is collected by the cleaning device.

The transfer section 3 includes a transfer roller 16 (transfer means) disposed to face the photosensitive drum 7, and a transfer power supply 17 (power supply means) for producing a predetermined potential difference (transfer voltage) between the photosensitive drum 7 and the transfer roller 16. The transfer roller 16 is made of, for example, a rubber foam produced from urethane as its base material, and has a volume resistivity of $10^8$ Ω·cm. The structure of the transfer roller 16 will be described in detail later. In the transfer section 3, when a transfer voltage is applied to the transfer roller 16 from the transfer power supply 17, the toner image formed on the photosensitive drum 7 is transferred to the paper 18 supplied between the photosensitive drum 7 and the transfer roller 16.

The paper feed section 4 includes a feed cassette 19 for storing papers 18 of a predetermined size. The paper 18 can be a normal paper, a sheet used for overhead projector (hereinafter just referred to as the "OHP sheet"), etc. The feed cassette 19 is detachably attached to the main body of the image forming apparatus. The paper 18 stored in the feed cassette 19 is fed one sheet at a time from the topmost section of the feed cassette 19 toward the transfer section 3 by a pickup roller 20. Though not shown in FIG. 2, the paper feed section 4 is also provided with a manual-feed tray for supplying the paper 18 manually sheet by sheet.

Provided between the pickup roller 20 and the transfer section 3 are a pair of resist rollers 21 for stopping temporarily the paper 18 fed by the pickup roller 20, and transporting the paper 18 to the transfer section 3 at a predetermined timing and a predetermined speed. The timing is such a timing that the leading end of the toner image on the photosensitive drum 7 coincides with the leading end of the paper 18 at the transfer position between the photosensitive drum 7 and the transfer roller 16.

Moreover, arranged on the paper feeding side of the transfer section 3 is a feed guide 22 for guiding the transport of the paper 18 from the paper feed section 4 to the transfer section 3. Additionally, the paper feed section 4 includes a feed sensor (not shown) for detecting that the paper 18 has been supplied.

The above-mentioned respective rollers and photosensitive drum 7 are driven and rotated by a driving device (not shown). The rotations of the rollers and photosensitive drum 7 are suitably controlled at predetermined timing by a process control unit (not shown) provided in the main body of the image forming apparatus.

The fixing section 5 includes a heat roller 23, a heater 24, a pressure roller 25, a temperature sensor 26, and a temperature control circuit 27.

The heat roller 23 is made of an aluminum pipe with a thickness of 2 mm. The heater 24 is formed by, for example, a halogen lamp, and incorporated into the heat roller 23. The pressure roller 25 is made of, for example, a silicone resin, and disposed to face the heat roller 23. For instance, a 2-kilogram load is applied by, for example, springs (not shown), to both ends of the rotation axis of each of the heat roller 23 and pressure roller 25 so as to apply pressure to the paper 18 nipped between the heat roller 23 and pressure roller 25. The temperature sensor 26 measures the surface temperature of the heat roller 23. The temperature control circuit 27 is controlled by a main control section, and controls the switching of the heater 24 between ON and OFF according to the result of measurement performed by the temperature sensor 26 so as to maintain the surface temperature of the heat roller 23 at, for example, 150° C.

The fixing section 5 includes an output sensor (not shown) for detecting that the paper 18 has been output. Moreover, provided on the paper output side of the fixing section 5 are eject rollers 28 for outputting the paper carrying the toner image fixed thereto from the image forming apparatus, and an output tray 29 for holding the output paper 18. Furthermore, the fixing section 5 includes the transport guide 30 for guiding the paper 18 transported from the transfer section 3, to the eject rollers 28.

The materials of the heat roller 23, heater 24, and pressure roller 25 are not particularly restricted. Besides, the surface temperature of the heat roller 23 is not particularly restricted. In addition, the fixing section 5 can be arranged so that the toner image is fixed to the paper 18 by application of either heat or pressure.

Next, the following description will explain the operation of the image forming apparatus having the above-mentioned structure.

When a printing operation is started by a print command from a host computer (not shown), first, a sheet of paper 18 is taken out of the feed cassette 19 by the pickup roller 20, and sent to the resist rollers 21. The resist rollers 21 feed the paper 18 at a predetermined speed to a region where the photosensitive drum 7 and the transfer roller 16 face each other.

An electric potential of, for example, −1100 V is applied to the charging roller 8 by the charging power supply 11 in synchronism with the printing operation so that the surface of the photosensitive drum 7 is uniformly charged to have a surface potential of, for example, −600 V. In this state, the photosensitive drum 7 rotates. When the charged region on the surface of the photosensitive drum 7 reaches a region facing the laser unit 6, the laser unit 6 irradiates the charged region of the photosensitive drum 7 with laser light corresponding to desired image data.

When the photosensitive drum 7 is irradiated with the laser light, the resistance of the photosensitive drum 7 is lowered because of its photosensitivity, the charge on the surface is neutralized, and the surface potential is lowered. As a result, an electrostatic latent image corresponding to the image data is formed on the surface of the photosensitive drum 7.

When the electrostatic latent image moves to a region facing the developing section 9 with a rotation of the photosensitive drum 7, it is developed by the toner 12 supplied from the developing section 9, and a toner image is formed. This toner image is transported to a transfer position to the paper 18, with a further rotation of the photosensitive drum 7.

When the toner image reaches a region facing the transfer roller 16, it is brought into contact with the paper 18 transported to that region, by the resist rollers 21. Then, a predetermined transfer electric potential is applied by the transfer power supply 17, and the toner image is transferred to the paper 18.

Subsequently, the unfixed toner image is fixed to the paper 18 by passing the paper 18 between the heat roller 23 and the pressure roller 25. Thereafter, the paper 18 is output to the output tray 29 by the eject rollers 28.

Meanwhile, the toner which is not transferred to the paper 18 is transported to a region facing the cleaning device (not shown) by the subsequent rotation of the photosensitive drum 7, and collected by the cleaning device. Next, the surface of the photosensitive drum 7 is irradiated with the charge removing light from the charge removing lamp 10 so as to naturalize and remove the unnecessary charge of the electrostatic latent image on the surface of the photosensitive drum 7. Then, the image forming apparatus is ready for the next image formation.

Note that the electric potential to be applied to the charging roller by the charging power supply 11 is not necessarily limited to the above-mentioned −1100 V. In other words, it is possible to apply an electric potential of, for example, −1200 V. In this case, there is an advantage that it is easy to set the respective process conditions for image formation.

Next, the following description will explain in detail the transfer roller 16 as a characteristic of the present invention.

As illustrated in FIG. 1(*a*), the transfer roller 16 is formed by fixing an elastic layer 16*b* (elastic member) for pressing the paper 18 against the photosensitive drum 7, to the external surface of a cylindrical base member 16*a*.

The base member 16*a* is a semiconductive member formed from, for example, a silicone resin, conductive carbon black, etc, and has a relative permittivity ranging, for example, between around 20 and 30. Alternatively, the base member 16*a* may be constructed by a member having an insulating property or a medium resistance. The base member 16*a* is hollow, and closed. Thus, a region 31 having a high resistance equal to the atmosphere is formed inside the base member 16*a*. Moreover, provided in the region 31 is a discharge electrode 32 (discharging means) serving as the rotation axis of the transfer roller 16. The discharge electrode 32 is placed along a cross direction of the paper 18 (a direction perpendicular to the transport direction of the paper 18), and generates charge on the transfer roller 16 by discharge and forms a transfer electric field between the photosensitive drum 7 and the transfer roller 16. An electric potential of, for example, 4 kV is applied to the discharge electrode 32 by the transfer power supply 17 (see FIG. 2), and discharge occurs inside the transfer roller 16 upon the application of the electric potential.

Moreover, a gas such as neon and helium is sealed in the base member 16*a*, and thus discharge between the discharge electrode 32 and the base member 16*a* occurs easily. Furthermore, according to the present invention, the region 31 is maintained in a state of low pressure so as to form certainly a transfer electric field in the nip region between the photosensitive drum 7 and transfer roller 16 by the discharge.

Note that the inside of the base member 16*a* can be filled with a substance having a form, such as a liquid having a high resistance equal to the atmosphere, instead of making the inside of the base member 16*a* hollow. Besides, the inside of the region 31 can be in a state with atmospheric pressure. Even in this case, needless to say, it is possible to cause discharge.

The elastic layer 16*b* is formed from, for example, urethane rubber or silicone rubber with a thickness of 5 mm, and has a shorter length in the direction of the rotation axis than the base member 16*a*.

With the use of such an elastic layer 16*b*, the paper 18 can be pressed against the photosensitive drum 7 uniformly with a predetermined transfer pressure, thereby providing good transfer characteristics. As a result, good image formation can be performed.

For instance, when the papers 18 of a uniform size are used, considering the characteristics of the image forming apparatus, a good transfer may be realized without providing the elastic layer 16*b*. In such a case, considering the cost, life and reliability of the apparatus, it is preferred not to provide the elastic layer 16*b*.

A bearing section 16*d* for bearing a shaft (not shown) for pressing the transfer roller 16 itself against the photosensitive drum 7 is provided at portions of the surface of the base member 16*a*, which portions are not covered with the elastic layer 16*b*. For example, a 500-gram load is applied to both ends of the shaft so as to press the transfer roller 16 against the photosensitive drum 7.

The elastic layer 16*b* covering the surface of the base member 16*a* is a high resistant material, and induced charges are easily accumulated on the surface of the elastic layer 16*b* particularly during high-speed printing. If the charge on the surface of the elastic layer 16*b* is not neutralized and is thus increased, the electric field at the time of the transfer shifts from a predetermined value. Consequently, good transfer characteristics cannot be obtained.

Therefore, in the present invention, as illustrated in FIG. 2, a charge removing roller 33 (charge removing means) is arranged in contact with the surface of the transfer roller 16. The charge removing roller 33 removes the charge on the surface of the elastic layer 16*b* of the transfer roller 16 as the need arises. This arrangement prevents the above-mentioned problem, and avoids deterioration of the image quality. More specifically, the charge removing roller 33 is grounded via a charge removing power supply 34, and a charge removing voltage to be applied to the charge removing roller 33 is adjusted by the charge removing power supply 34.

As the charge removing means, it is possible to use a member capable of removing the charge on the surface of the elastic layer 16*b*, for example, a charge removing brush or a charge remover using corona discharge, as well as the above-mentioned charge removing roller 33. Moreover, the charge removing means may be directly grounded. Suitable charge removing means and charge removing method can be selected according to the characteristics of the image forming apparatus. In the case where the elastic layer 16*b* is not provided, the charge removing means may be arranged to remove the charge on the base member 16*a*.

Figure 3:
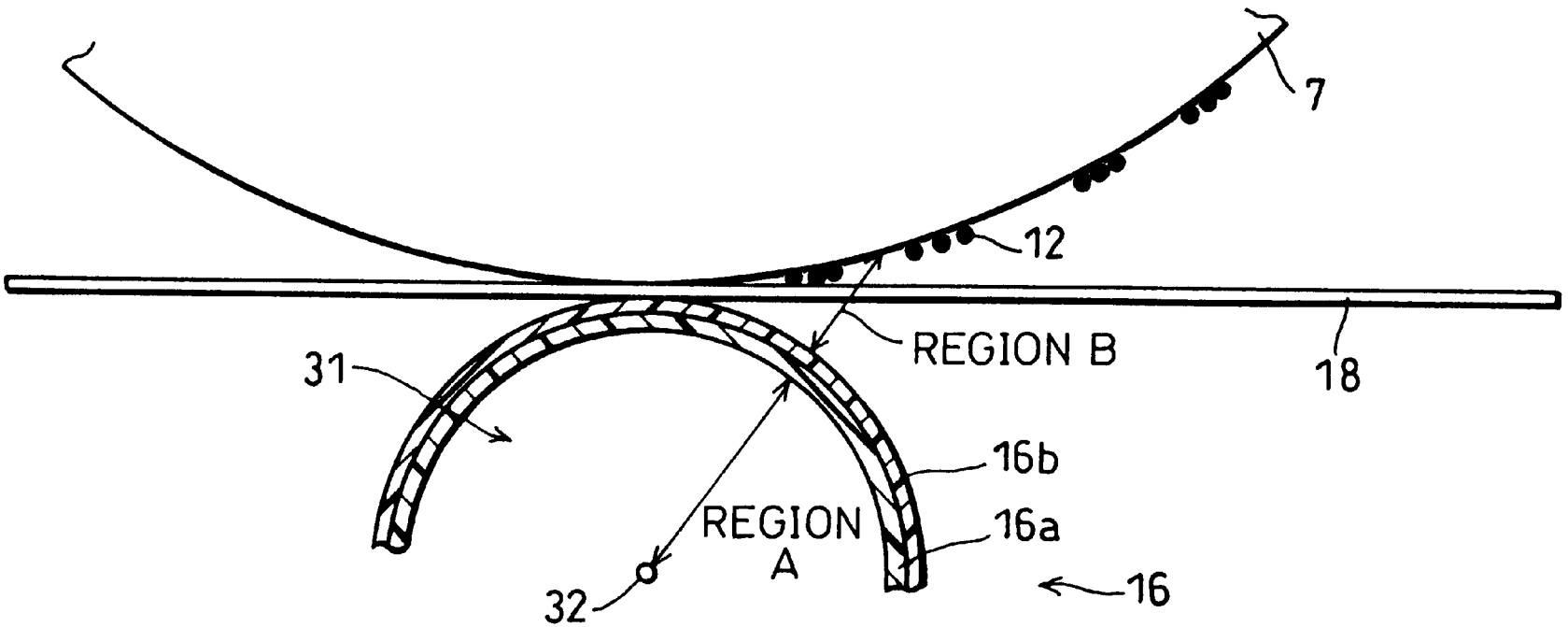
FIG. 3 is an explanatory view showing two regions formed between a discharge electrode in the transfer roller and a photosensitive drum.

In the above-mentioned structure, as shown in FIG. 3, when the transfer electric potential is applied to the discharge electrode 32 from the transfer power supply 17, the transfer electric potential is separately applied to a region A (first region) between the discharge electrode 32 and the base member 16*a*, and to a region B (second region) that is a region between the transfer roller 16 and the photosensitive drum 7 and located on the upstream side of the nip region along the rotating direction (clockwise direction in FIG. 3) of the photosensitive drum 7. In the case of the present invention, as described above, since the region A within the region 31 is a region having a high resistance equal to the atmosphere, it has the same resistance as the region B formed by the atmosphere. Consequently, for instance, when performing high-speed image formation or when using a thick paper 18 or an OHP sheet, even if a high electric potential is applied to the discharge electrode 32, the electric potential in the region B does not increase to a value higher than a necessary value.

Namely, in the two regions arranged in series, the fractions of the transfer electric potential to be applied to the discharge electrode 32 are concentrated in one region having a higher resistance. However, in the present invention, since there is no big difference in resistance between the two regions (regions A and B), the fractions of the transfer electric potential can never be concentrated in only one of the regions.

Meanwhile, it will be appreciated from the equation shown in the BACKGROUND OF THE INVENTION section that the electric fields formed in the respective regions (regions A and B) are proportional to the electric potentials applied to those regions. In the present invention, as described above, since the electric potential of the region B does not increase to a value more than the necessary value, the electric field formed in the region B does not become higher than the necessary value.

Therefore, even when a high transfer electric potential is applied to the discharge electrode 32 to perform high speed image formation, the toner 12 does not start flying from the photosensitive drum 7 to the paper 18, in regions other than the nip region. Consequently, the above-mentioned structure can provide a good quality image of high contrast without blurring the outline of the image.

Figure 4:
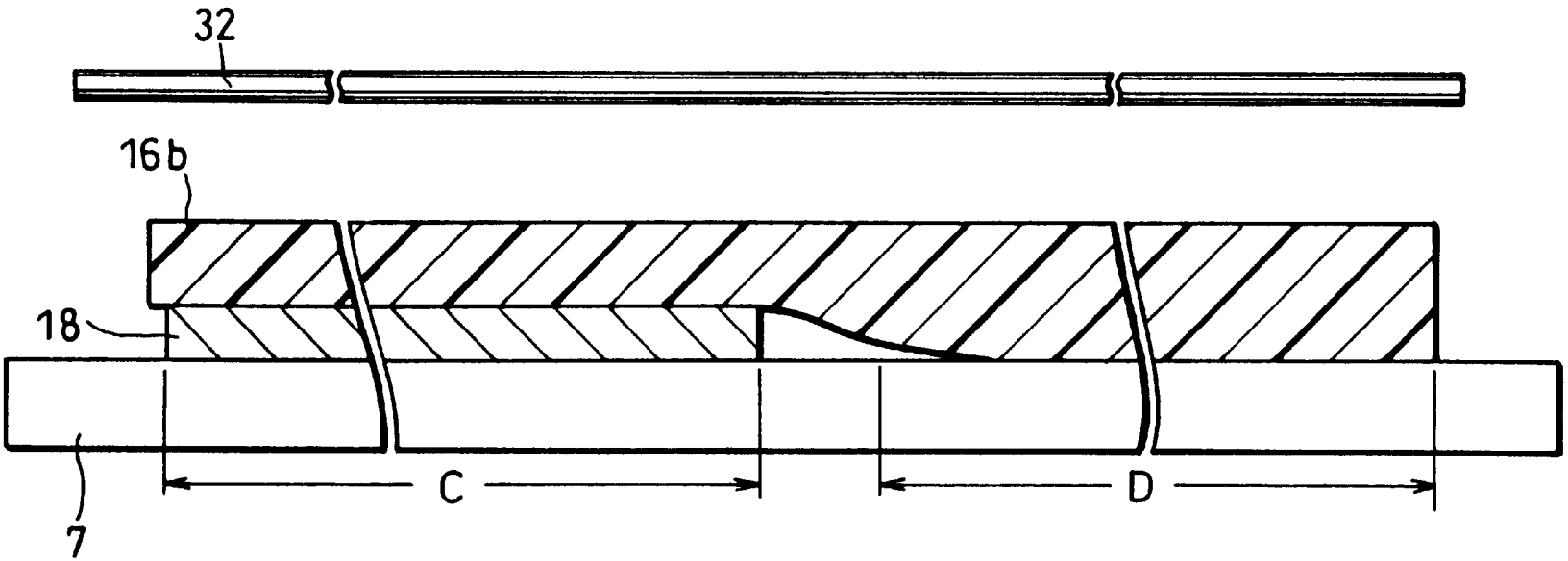
FIG. 4 is a cross sectional view showing a state in which an elastic layer of the transfer roller is in contact with the photosensitive drum in a region where a sheet is not present when the sheet of a small width is used.

Furthermore, according to the present invention, even when a high transfer electric potential is applied, the potential of the region B does increase to a value higher than the necessary value. Therefore, a predetermined electric potential is also applied to the region A certainly, and a predetermined electric field is surely formed in the region A. Hence, as shown in FIG. 4, when the paper 18 of a small width, for example, a post card, is used, the elastic layer 16*b* of the transfer roller 16 presses the paper 18 against the photosensitive drum 7 at a predetermined region C, while it is in direct contact with the photosensitive drum 7 at a region D other than the region C. Even in this case, the predetermined electric field is surely formed between the discharge electrode 32 and the base member 16*a* (see FIG. 3), irrespective of the regions C and D.

Accordingly, the electric field and a transfer current can never be concentrated in only the region D. As a result, in the region C, a shortage of the transfer current is avoided, thereby achieving a good transfer even when the paper 18 of a small size is used. Besides, in this case, since there is no need to construct the transfer power supply 17 by a large-scale power supply with high output or to increase the resistance of the transfer roller 16, it is possible to prevent an increase in the cost of the image forming apparatus and to decrease the size of the apparatus.

In addition, the inside of the base member 16*a* is closed, and discharge occurs in the base member 16*a*. Therefore, substances harmful to the human body, for example, ozone, generated by the discharge, can never leak out of the base member 16*a*. Consequently, the image forming apparatus of the present invention is not harmful to the human body, and is excellent from an environmental and hygienical point of view.

Figure 5:
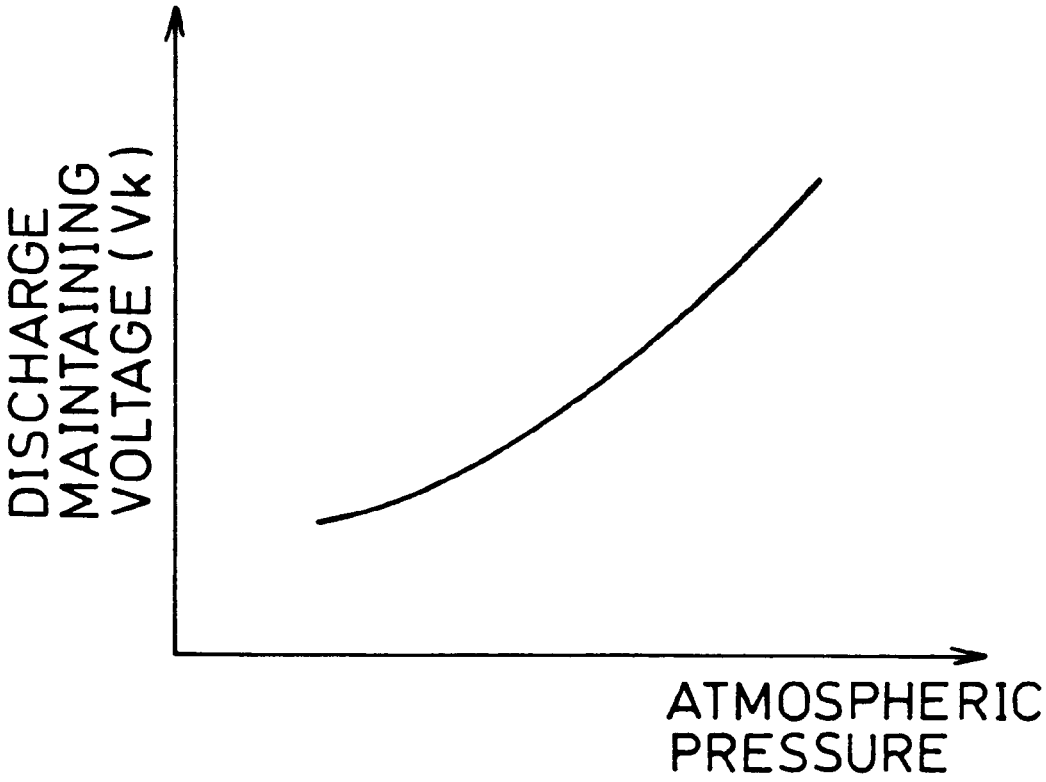
FIG. 5 is a graph showing the relationship between the atmospheric pressure in the transfer roller and a discharge maintaining voltage.

FIG. 5 shows the relationship between the atmosphere inside the base member 16*a* and discharge maintaining voltage Vk. The discharge maintaining voltage Vk is a voltage for causing discharge once and then maintaining the discharge. It should be appreciated from FIG. 5 that the discharge maintaining voltage Vk decreases with a lowering of the atmospheric pressure in the base member 16. This means that when the atmospheric pressure in the base member 16*a* is low, the discharge is maintained more easily even when a low voltage is applied. Besides, a low pressure discharge is less likely to be a discharge having spark, compared with an atmospheric pressure discharge.

Therefore, like the present invention, by discharging while maintaining the inside of the base member 16*a* in the low pressure state, it is possible to generate charge on the base member 16*a* in a stable manner by stable discharge. As a result, compared with a case adopting atmospheric discharge, the transfer performance is significantly improved especially in the nip region.

Figure 6:
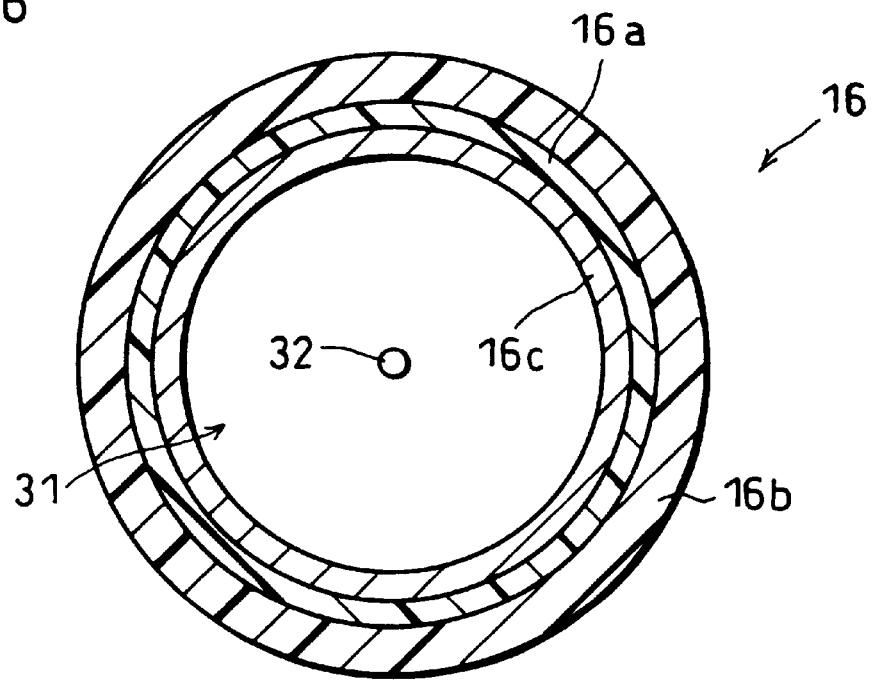
FIG. 6 shows another example of the structure of the transfer roller by illustrating a cross section of the transfer roller, wherein a metal layer is provided in the transfer roller.

In this embodiment, discharge is caused between the discharge electrode 32 and the inner surface of the base member 16*a*. However, for example, as shown in FIG. 6, it is possible to arrange a metal layer 16*c* on the entire inner surface of the base member 16*a*, i.e., on a portion inside the metal member 16*a*, which portion faces the discharge electrode 32, and to cause discharge between the metal layer 16*c* and the discharge electrode 32. In this case, the low pressure discharge is further facilitated, and the resultant discharge is stable. Consequently, a uniform, stable transfer electric field is surely formed between the photosensitive drum 7 and the transfer roller 16, thereby achieving further improved image formation.

Figure 7:
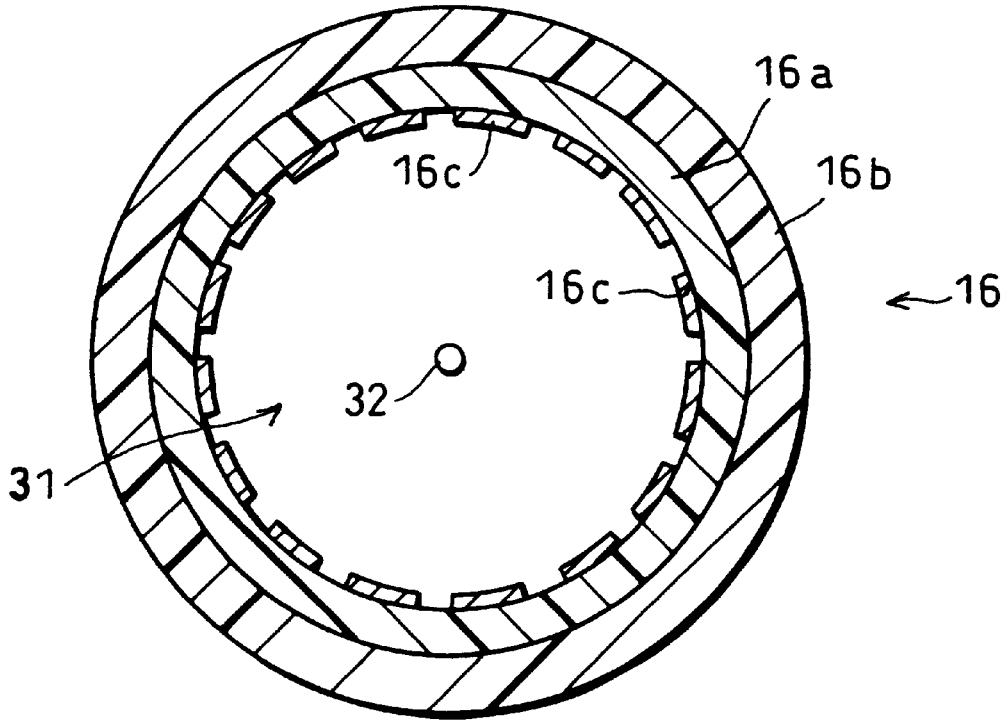
FIG. 7 shows still another example of the structure of the transfer roller by illustrating a cross section of the example in which the metal layer in the transfer roller is divided into a plurality of pieces along the rotation axis of the transfer roller.

Besides, when the metal layer 16*c* is provided, as illustrated in FIG. 7, if the metal layer 16 is separated into a plurality of pieces parallel to the rotation axis of the transfer roller 16 arranged in the cross direction of the paper 18, the following functions and effects are additionally produced.

In this case, the transfer current flowing in the elastic layer 16*b*, in the rotating direction of the transfer roller 16, is limited to a certain extent, and thereby preventing a flow of the transfer current in a transport direction of the paper 18, for example, from a portion where the paper 18 is present to a portion where the paper 18 is not present. It is thus possible to surely prevent such a drawback that the electric field is concentrated in regions where the paper 18 is not present, in the vicinity of the leading end and the trailing end of the paper 18, and certainly avoid deterioration of the image in the vicinity of the leading end and the trailing end of the paper 18.

Additionally, in the present invention, the charge removing means is provided. In this case, the transfer electric field in the transfer section 3 may be influenced by the structure of the image forming apparatus, the structure of the charge removing means, the charge removing method, the electric potential used, etc. However, such influences can be prevented by providing the metal layer 16*c* as mentioned above.

Figure 8:
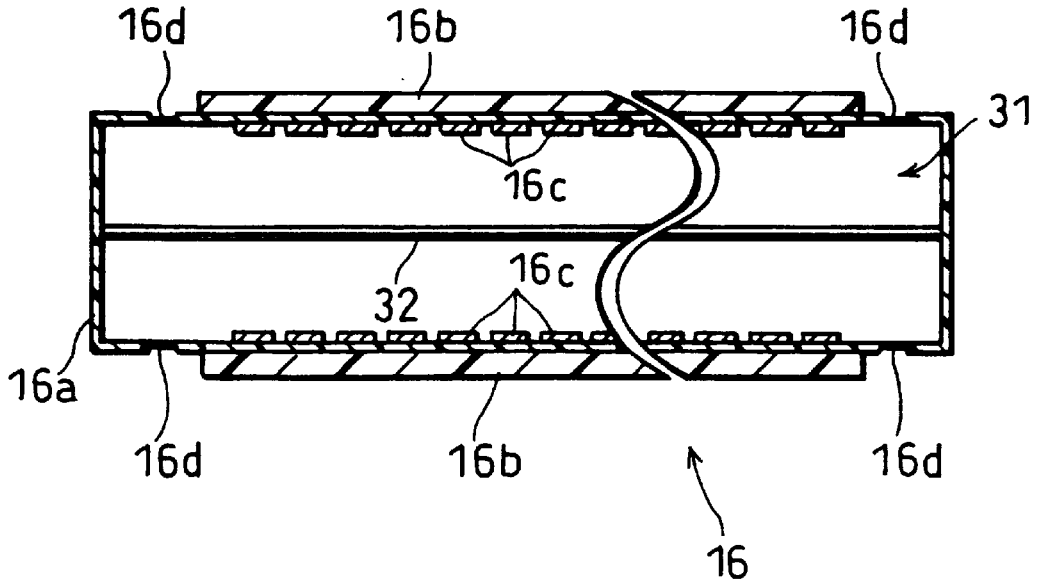
FIG. 8 shows yet another example of the structure of the transfer roller by illustrating a cross section of the example in which the metal layer in the transfer roller is divided into a plurality of pieces perpendicularly to the rotation axis of the transfer roller.

On the other hand, as shown in FIG. 8, the metal layer 16*c* may be separated into pieces perpendicularly to the rotation axis of the transfer roller 16 arranged so that the rotation axis is parallel to the cross direction of the paper 18. In this case, the individual metal layer 16*c* is a strip electrode in the form of a ring placed along the inner surface of the base member 16*a*, and plural pieces of the strip electrodes are arranged at predetermined intervals along the rotation axis of the transfer roller 16.

In this structure, it is possible to limit the transfer current flowing in the elastic layer 16*b*, in a direction parallel to the rotation axis of the transfer roller 16. Therefore, when the paper 18 of a small width is used, it is possible to surely prevent the transfer current from flowing to the contact section between the elastic layer 16*b* and the photosensitive drum 7 along the above-mentioned direction. As a result, good transfer characteristics can be obtained with respect to the transfer paper 18 of any width, irrespective of the width of the transfer paper 18, and good image formation can be performed.

Figure 9:
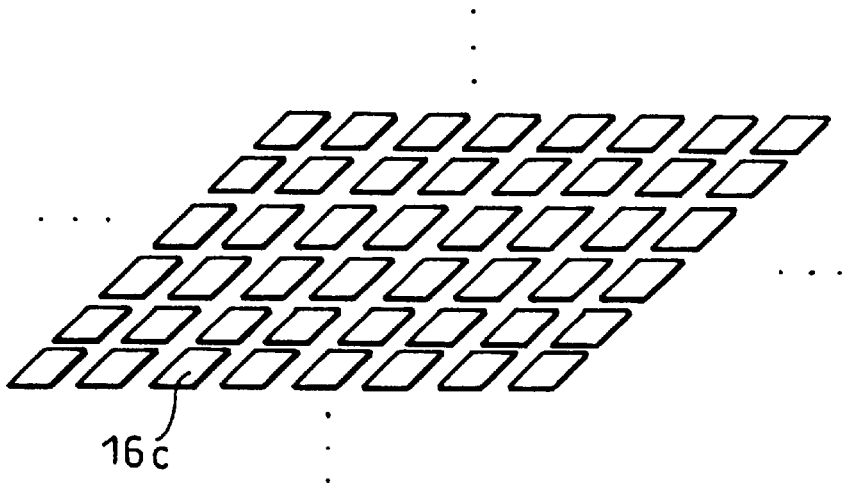
FIG. 9 shows a further example of the structure of the transfer roller by two-dimensionally illustrating a perspective view of the exploded inside of the transfer roller wherein the metal layer in the transfer roller is divided into a plurality of pieces along the rotation axis of the transfer roller and also divided into a plurality of pieces perpendicularly to the rotation axis of the transfer roller.

Furthermore, an arrangement adopting both the structures shown in FIGS. 7 and 8 can be used. More specifically, the metal layer 16*c* can be divided into a plurality of pieces along the rotation axis of the transfer roller 16, and also be divided into pieces perpendicularly to the rotation axis of the transfer roller 16. In this arrangement, as shown in FIG. 9, a plurality of square metal layers 16*c* are formed on the inner surface of the base member 16*a*. FIG. 9 shows two-dimensionally the exploded inner surface of the base member 16*a*. Needless to say, this arrangement produces the effects of the structures shown in FIGS. 7 and 8 at a time.

Besides, according to the present invention, the charge on the surface of the elastic layer 16*b* of high resistance is removable by the charge removing roller 33. However, if the volume resistivity of the elastic layer 16*b* is appropriately adjusted by, for example, mixing carbon black, ion inducing agent, conductive fiber, etc. into the elastic layer 16*b*, it is possible to prevent an increase in the amount of charge on the elastic layer 16*b* without providing the charge removing roller 33. In this case, since the charge removing roller 33 does not need to be installed, the number of components and the size of the image forming apparatus can be reduced, and the increase in the cost of the image forming apparatus can be avoided. Moreover, in this case, since a transfer electric field disorder because of the increase in the amount of charge on the elastic layer 16*b* is prevented, the reliability of the image forming apparatus can be improved.

At this time, if the volume resistivity of the elastic layer 16*b* is smaller than $10^5$ Ω·cm, when the paper 18 of a small width is used, the transfer electric field is likely to be concentrated in the contact section between the elastic layer 16*b* and the photosensitive drum 7. On the other hand, if the volume resistivity of the elastic layer 16*b* is greater than $10^{14}$ Ω·cm, the charge on the surface of the elastic layer 16*b* is less likely to be neutralized, and the amount of charge on the surface increases. Therefore, the volume resistivity of the elastic layer 16*b* is preferably, for example, between around $10^5$ Ω·cm and $10^{14}$ Ω·cm. However, the volume resistivity of the elastic layer 16*b* is not necessarily limited to this range, and can be determined suitably by considering the processing speed of the image forming apparatus, the amount of charge generated, the charge neutralizing time, various characteristics of the apparatus, etc.

In the present invention, since a DC electric potential is applied to the discharge electrode 32 from the transfer power supply 17, a DC electric field is formed in the region 31 maintained in the low pressure state. However, it is possible to adopt a structure in which the transfer power supply 17 applies a voltage having a frequency component to the discharge electrode 32 so that, for example, an electric field having ripple components as well as an electric field on which AC components are superimposed and an electric field having electric field components produced by amplitude modulation of the AC components are formed in the region 31. In this case, since the low pressure discharge in the region 31 is further stabilized, good transfer characteristics can be obtained more certainly, and further improved image information can be performed.

In the present invention, the transfer roller 16 as the transfer means is used for both of the transport of the paper 18 and the transfer of the toner image to the paper 18. However, the transport of the paper 18 and the transfer of the toner image to the paper 18 can be performed separately.

Namely, it is possible to employ an arrangement shown in FIG. 10(*a*) in which a transfer belt 35 is used as means for transporting the paper 18 and stretched by two tension rollers 36, and the above-mentioned transfer roller 16 is disposed as the transfer means at the transfer position. In this case, for example, the transfer belt 35 is made of a film material such as PET (polyethylene terephthalate) and PVDF (vinylidene fluoride), and driven by the tension rollers 36. In this arrangement, since the transfer belt 35 is used, the paper 18 is easily transported.

Alternatively, it is also possible to use an arrangement shown in FIG. 10(*b*) in which the transport roller 16 is disposed at the transfer position, and the transfer belt 35 is stretched by the transfer roller 16 and a single tension roller 36.

In the case where the transfer belt 35 is used, it is possible to apply charge to the surface of the paper 18 so that the transfer belt 35 electrostatically attracts the paper 18. This arrangement is particularly preferable for a color image forming apparatus explained later in the second embodiment. Additionally, it is of course possible to use arrangements in which the transfer belt is formed by the elastic layer 16*b*, and the transfer roller 16 without the elastic layer 16*b* is arranged as shown in FIGS. 10(*a*) and 10(*b*).

Furthermore, it is possible to use the transfer roller 16 of the present invention in an image forming apparatus having a drum-shaped intermediate transfer body. In this case, the same transfer characteristics as the present invention can be obtained by disposing the transfer roller 16 inside or outside of the intermediate transfer body.

Next, the following description will explain that the image forming apparatus of the present invention can surely perform image formation even when the characteristics of the paper 18 change with an environmental variation.

The variation of relative permittivity of the paper 18 between a high-temperature, high-humidity environment and a low-temperature, low-humidity environment is usually within a range of from around 2 to 9. Here, denoting the relative permittivity of the paper 18 by $\epsilon_{rp}$ and the relative permittivity of the transfer roller by $\epsilon_{rr}$, the composite relative permittivity $\epsilon_r$ of the paper 18 and transfer roller 16 is given by $$\epsilon_r=(\epsilon_{rp}\cdot\epsilon_{rr})/(\epsilon_{rp}+\epsilon_{rr}).$$

Therefore, it would be understood that if the relative permittivity $\epsilon_{rr}$ of the transfer roller 16 increases, the composite relative permittivity $\epsilon_r$ varies greatly. Here, when the composite relative permittivity $\epsilon_r$ is high, the electric field strength acting on the toner 12 on the photosensitive drum 7 is apt to change to a great degree. Hence, the transfer characteristics vary considerably. By the way, since the relative permittivity of a conventional transfer roller is high, for example, around 100, a good transfer according to the environmental variation could not be achieved due to the above-mentioned variation of the transfer characteristics.

In contrast, as mentioned above, the relative permittivity of the transfer roller 16 of the present invention is in the range of around 20 to 30, and is much smaller than the conventional one. Therefore, even if the relative permittivity of the paper 18 varies with the environmental variation, the variation of the composite relative permittivity $\epsilon_r$ (the variation of the apparent capacity seen from the transfer power supply 17) can be made smaller than the conventional variation. As a result, the variation of the electric field strength acting on the toner 12 and the variation of the transfer characteristics become smaller. It is thus possible to perform stable image formation against the environmental variation.

Note that the transfer roller 16 can be composed only of a silicone resin. In this case, since the relative permittivity of the transfer roller 16 becomes around 2 to 3, the composite relative permittivity $\epsilon_r$ can further be decreased. Thus, even if the variation of the characteristics of the paper 18 due to the environmental variation is taken into consideration, it is possible to perform further stable image formation.

This embodiment is explained by illustrating an image forming apparatus adopting the Carlson process as an example, but is applicable to image forming apparatuses using various basic principles, such as a principle of forming an electrostatic latent image by an ion flow process. Moreover, although the toner 12 is used as developer in this embodiment, it is possible to use an ink.

Furthermore, the image forming apparatus of this embodiment can be used as an output device in a computer, and can also be used suitably as the printing section of a word processor and a facsimile machine, the printing section of a digital copying machine, a digital printer, a plotter, etc. Besides, the constituent members of the above-mentioned image forming apparatus are applicable to, for example, the corresponding parts of a laser printer.

Embodiment 2

Figure 11:
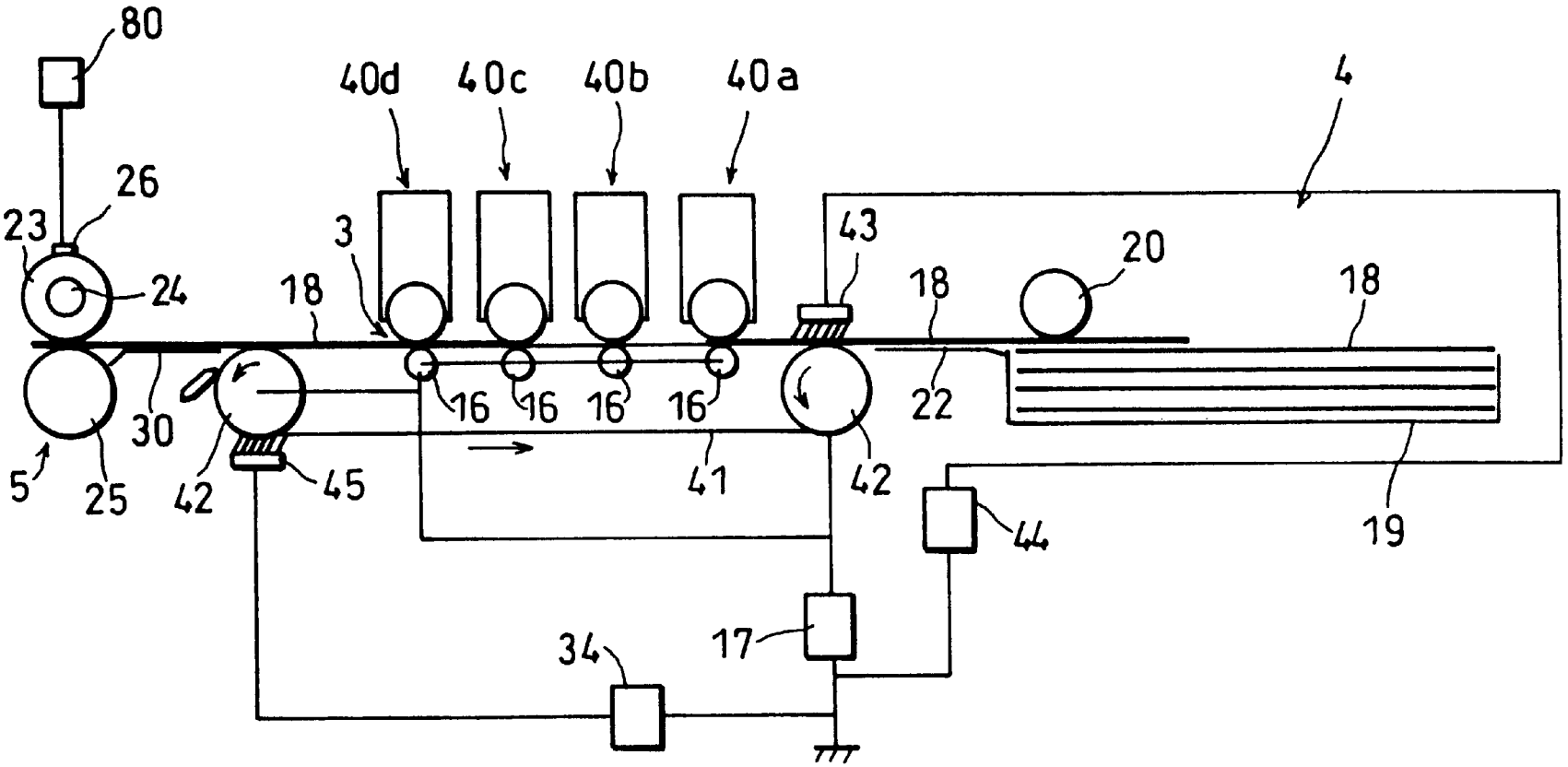
FIG. 11 is an explanatory view showing a schematic structure of a color image forming apparatus according to another embodiment of the present invention.

The following description will explain another embodiment of the present invention with reference to FIG. 11. This embodiment explains an example in which the transfer roller 16 used in the first embodiment is applied to a color image forming apparatus. For the sake of simplifying the explanation, the members having the same functions as those in the first embodiment will be designated by the same codes and the explanation thereof will be omitted.

As illustrated in FIG. 11, the image forming apparatus of this embodiment includes a plurality of image forming sections 40*a* to 40*d*. Each of the image forming sections 40*a* to 40*d* includes at least an exposure section for exposing a photosensitive body, the photosensitive body for carrying an electrostatic latent image formed by the exposure, and a developing device for developing the electrostatic latent image with toner. In FIG. 11, these constituent members are illustrated as a single integrated part. The image forming sections 40*a* to 40*d* correspond, for example, to formations of yellow, magenta, cyan, and black images, and are arranged in this order in a transport direction of the paper 18 from the paper feed section 4.

A transfer roller 16 used in the first embodiment is disposed at each of positions facing the image forming sections 40*a* to 40*d* via a dielectric belt 41. Each of the transfer rollers 16 is connected to the transfer power supply 17, and supplied with a predetermined transfer electric potential. The dielectric belt 41 is stretched by two tension rollers 42 made, for example, of PET or PVDF. The dielectric belt 41 may be made of the elastic layer 16*b* explained in the first embodiment. Like the transfer rollers 16, a predetermined electric potential is applied to the tension rollers 42 from the transfer power supply 17.

A charging brush 43 for supplying charge to the surface of the paper 18 is provided on the paper feed section 4 side of the image forming section 40*a*, at a section facing one of the tension rollers 42, so as to electrostatically attract the paper 18 to the dielectric belt 41. The charging blush 43 is connected to a charging power supply 44.

Meanwhile, a charge removing brush 45 for removing charge on the surface of the dielectric belt 41 is provided in the vicinity of the other tension roller 42 on the image forming section 40*d* side so that the charge removing brush 45 is in contact with the tension roller 42. The charge removing brush 45 is connected to the charge removing power supply 34, and supplied with a charge removing electric potential as the need arises.

Note that the structures of the paper feed section 4 and fixing section 5 are exactly the same as those of the first embodiment. Additionally, the transfer power supply 17, charge removing power supply 34, and charging power supply 44 are respectively grounded.

In the above-mentioned structure, a predetermined electric potential is applied from the charging power supply 44 via the charging brush 43 to the paper 18 transported from the paper feed section 4. On the other hand, a predetermined electric potential is applied to the tension rollers 42 from the transfer power supply 17. Therefore, since electrostatic charge is generated on the surface of the paper 18 by the potential difference, the paper 18 is attracted electrostatically to the dielectric belt 41 and transported to the transfer section 3 with a movement of the dielectric belt 41.

In the transfer section 3, the toner images formed by the image forming sections 40*a* to 40*d* are sequentially transferred to the paper 18 by the corresponding transfer rollers 16, in synchronism with the transport of the paper 18. At this time, since the transfer roller 16 includes therein a region of a high resistance equal to the atmosphere, even if a high electric potential is applied to the transfer roller 16, an electric field formed in a region between transfer roller 16 and the photosensitive body of each image forming section, on the upstream side of the nip region, can never increase to a value higher than a necessary value. Thus, the toner can never start flying in this region.

After all of the toner images are transferred to the paper 18, the paper 18 is separated from the dielectric belt 41 because of the curvature of the tension roller 42, and guided to the fixing section 5 by the transport guide 30. In the fixing section 5, the unfixed toner images are fixed to the paper 18 by the functions of the heat roller 23 and the pressure roller 25, and then output from the image forming apparatus. Meanwhile, after the transport of the paper 18 is completed, the charge on the transfer belt 41 is removed by the charge removing brush 45 to which the charge removing potential is applied by the charge removing power supply 34.

As described above, in the color image forming apparatus of this embodiment, since the transfer roller 16 used in the first embodiment is employed as the transfer means, it is possible to avoid various problems when a high electric potential is applied to the transfer roller 16, thereby providing a color image of good image quality.

Next, the following description will explain that the respective transfer rollers 16 of this embodiment are constructed according to the characteristics of toner.

As in the case of this embodiment, when more than one kind of toner is used, it is not preferred to perform a transfer under the same transfer conditions because the toner's characteristics (toner's charging ability, transferability to the paper 18, fixing ability, etc.) vary depending on the color of toner.

Hence, in this embodiment, a plurality of transfer rollers 16 of different structures are provided for the corresponding image forming sections 40*a* to 40*d*, respectively, and the transfer conditions are varied according to each of the image forming sections 40*a* to 40*d*. More specifically, for example, the thickness of the elastic layer 16*b* of the transfer roller 16 corresponding to the image forming section 40*a* is arranged to be 3 mm, and the thicknesses of the elastic layers 16*b* corresponding to the image forming sections 40*b*, 40*c*, and 40*d* are arranged to be 5 mm, 8 mm, and 10 mm, respectively.

Thus, by providing the transfer rollers 16 of different structures for the image forming sections 40*a* to 40*d*, respectively, the respective toners can sufficiently exhibit their characteristics and transferred to the paper 18 under the transfer conditions optimum for the respective toners, and a desired color image can be certainly obtained.

In addition to changing the thickness of each elastic layer 16*b*, it is possible to change the hardness and resistance of each elastic layer 16*b*, the material and resistance of each base member 16*a*, the distance between the discharge electrode 32 and each base member 16*a* (see FIG. 1), etc. according to each of the image forming sections 40*a* to 40*d*. With this arrangement, it is also possible to certainly obtain transfer conditions according to the characteristics of the toners used in the respective image forming sections 40*a* to 40*d*. Besides, the above-mentioned conditions can be suitably combined. Even in such a case, a good color image can be obtained under desired transfer conditions without impairing the characteristics of the toners of the respective colors.

Moreover, like the above-mentioned case, even when the transfer is controlled so that the transfer electric potential to be applied to the corresponding discharge electrode 32 is varied according to each of the image forming sections 40*a* to 40*d*, appropriate transfer conditions according to the characteristics of toner can be obtained.

Furthermore, for example, when the characteristics of the toners of the respective colors bear strong resemblance to each other or when quite margins (limits) are given in the transfer electric potential, the structures of the transfer rollers 16, etc., all or most of the structures of the respective transfer rollers 16 can be made identical. In this case, the number of the constituent parts of the transfer rollers 16 can be reduced on the whole, thereby limiting the increase in the costs of the transfer rollers 16 and in turn the increase in the cost of the image forming apparatus.

In addition, if all or most of the contents of the transfer control, such as the electric potential applied to each of the transfer rollers 16, are made identical, the transfer control can be simplified on the whole. Moreover, in this case, for example, since there is no need to provide the transfer power supply 17 for each of the transfer rollers 16, it is possible to reduce the number of the constituent parts and decrease the size of the image forming apparatus. Furthermore, the above-mentioned effects lead to an improvement of the reliability of the image forming apparatus.

Embodiment 3

Figure 12:
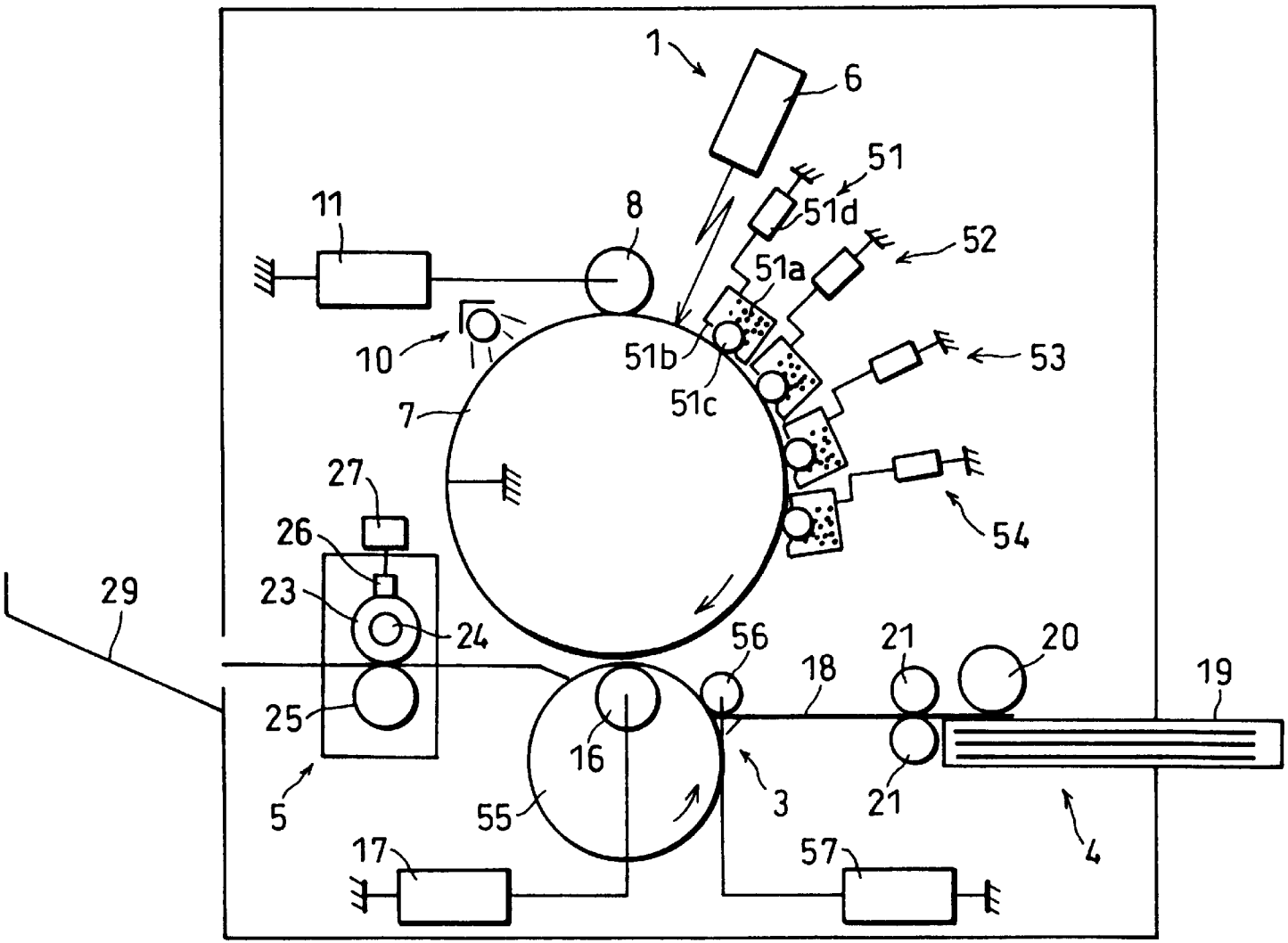
FIG. 12 is an explanatory view showing a schematic structure of a color image forming apparatus according to still another embodiment of the present invention.
Figure 13:
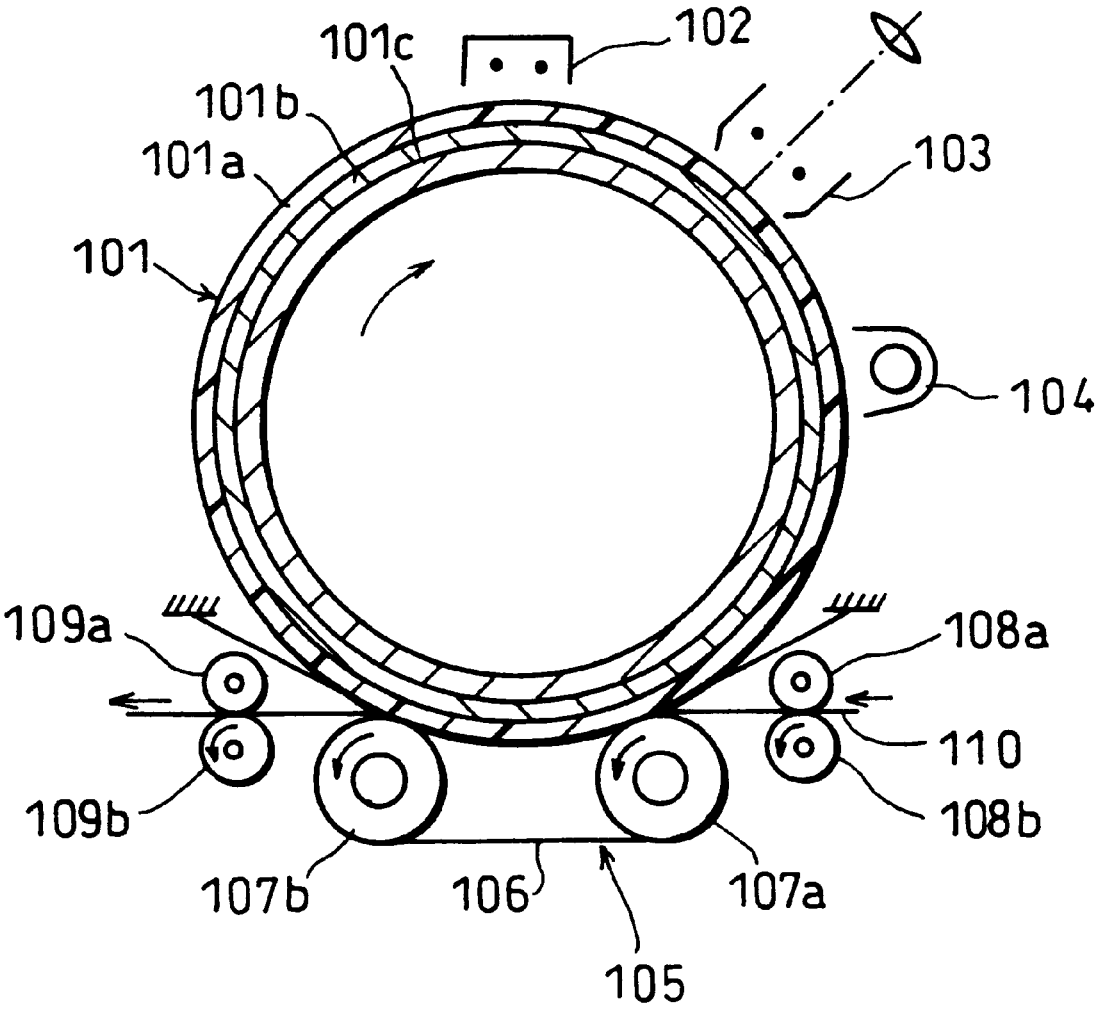
FIG. 13 is a cross sectional view showing a schematic structure of a conventional image forming apparatus adopting an electrostatic transfer system.
Figure 14:
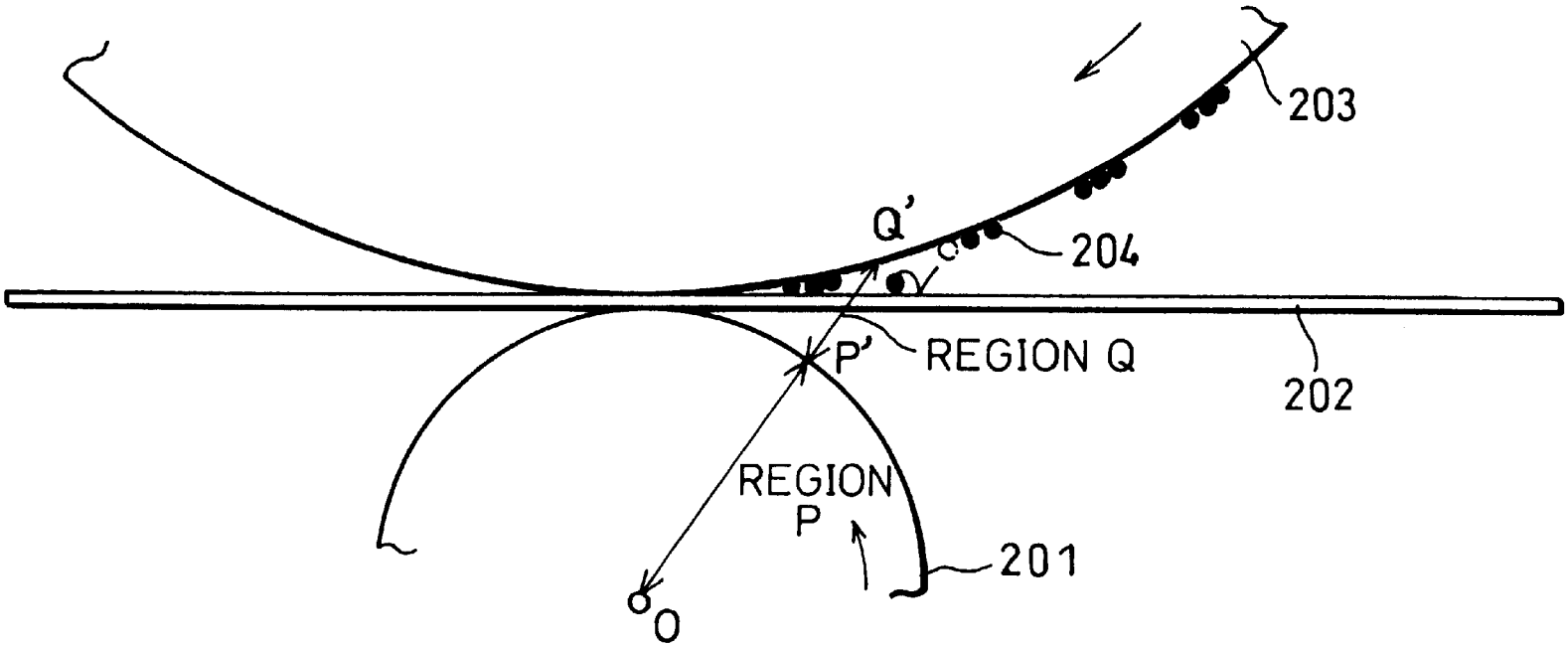
FIG. 14 is an explanatory view showing a state in which toner flies unpreparedly from a photosensitive body to a paper on the upstream side of a nip region in a conventional image forming apparatus adopting a developing and transfer system.
Figure 15:
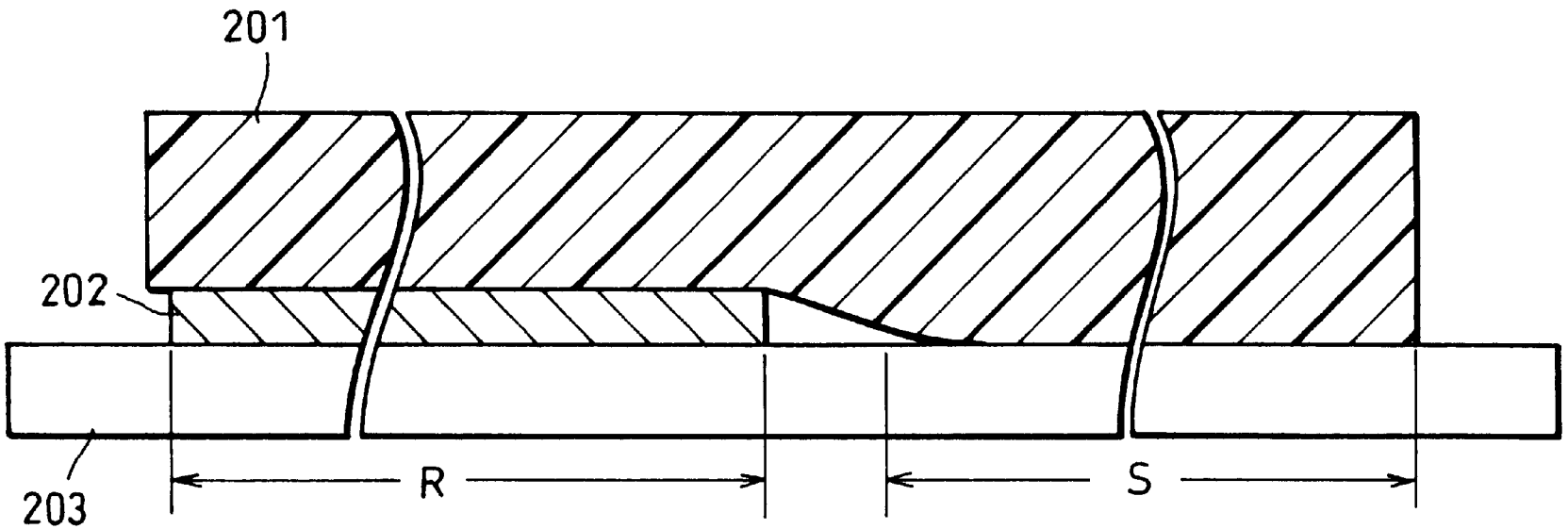
FIG. 15 is a cross sectional view showing a state of the image forming apparatus using a paper of a narrow width, wherein the transfer roller and the photosensitive body come into contact with each other in a region where the paper is not present.

The following description will explain still another embodiment of the present invention with reference to FIG. 12. For the sake of simplifying the explanation, the members having the same functions as those in the first and second embodiments will be designated by the same codes and the explanation thereof will be omitted.

As illustrated in FIG. 12, an image forming apparatus of this embodiment has the same structure as the image forming apparatus used in the first embodiment, except that four developing means 51 to 54 are arranged around the photosensitive drum 7. The developing means 51 includes a toner tank 51*b* for storing, for example, yellow toner 51*a*, a sleeve 51*c* for imparting a predetermined characteristic to the toner 51*a* and for supplying the toner 51*a* to the photosensitive drum 7 with a rotation thereof, and a development bias power supply 51*d* for applying an electric potential for supplying the toner 51*a* to the photosensitive drum 7. In this structure, the developing means 51 develops an electrostatic latent image formed on the photosensitive drum 7 so as to form a yellow image. The developing means 52 to 54 have the same structure as the developing means 51, but the respective developing tanks store magenta, cyan, and black toners, respectively.

In the transfer section 3, a drum 55 having an elastic layer on its surface is provided at a section facing the photosensitive drum 7. After a charging roller 56 applies an electric potential to the paper 18 supplied from the paper feed section 4, the paper 18 is electrostatically attracted to the surface of the drum 55. The charging roller 56 is supplied with an electric potential from a charging power supply 57.

Moreover, the transfer roller 16 used in the first embodiment is disposed inside the drum 55, at a section facing the photosensitive drum 7. The transfer roller 16 is supplied with a predetermined transfer electric potential from the transfer power supply 17.

In the above-mentioned structure, when the paper 18 is supplied to the transfer section 3 from the paper feed section 4, it is supplied with an electric potential by the charging roller 56, electrostatically attracted to the drum 55, and transported to the transfer position with a rotation of the drum 55.

Meanwhile, the surface of the photosensitive drum 7 has been charged to a predetermined electric potential in advance by the charging roller 8. When the charged region reaches a region facing the laser unit 6 of the exposure section 1, the laser unit 6 irradiates the charged region of the photosensitive drum 7 with laser light corresponding to, for example, yellow image data. As a result, an electrostatic latent image corresponding to the image data is formed on the surface of the photosensitive drum 7.

The electrostatic latent image is developed with the yellow toner 51*a* in the developing means 51. The visualized toner image is then transported to the transfer position that is a region facing the drum 55, with a rotation of the photosensitive drum 7.

At the transfer position, the predetermined transfer electric potential is applied to the transfer roller 16 from the transfer power supply 17, thereby transferring the toner image to the paper 18 electrostatically attracted to the surface of the drum 55.

At this time, since the transfer roller 16 has therein a region of a high resistance equal to the atmosphere, even if a high electric potential is applied to the transfer roller 16, an electric field formed in a region between the transfer roller 16 and the photosensitive drum 7 on the upstream side of the nip region can never increase to a value higher than a necessary value. Thus, the toner can never start flying in this region.

After the transfer of the toner image, waste toner on the surface of the photosensitive drum 7 is collected by the cleaning device (not shown), and the charge is removed by the charge removing lamp 10.

The above-mentioned charging, exposure, development, transfer, and charge removing processes are performed in the same manner as above with respect to the remaining colors (magenta, cyan, and black). Hence, the photosensitive drum 7 and the drum 55 are rotated a maximum of four times during a formation of a color image, and the toner images of the respective colors are sequentially transferred to the paper 18.

When the transfers of all of the toner images have been completed, the paper 18 is separated from the drum 55 by, for example, a separation claw (not shown), and then transported to the fixing section 5. When the unfixed toner images are fixed to the paper 18 in the fixing section 5, the paper 18 is output to the output tray 29.

As described above, in the color image forming apparatus of this embodiment, since the transfer roller 16 used in the first embodiment is employed as the transfer means, it is possible to avoid various problems when a high electric potential is applied to the transfer roller 16, and provide a color image of good image quality.

Moreover, the transfer of each toner image from the photosensitive drum 7 to the paper 18 is controlled according to the characteristics of the toner of each color. More specifically, in the first and second rotations of the photosensitive drum 7, for example, the transfer electric potential applied to the transfer roller 16 is varied according to the characteristics of the toner to be transferred.

Thus, by adjusting the transfer electric potential according to each toner's characteristics whenever a transfer is performed, it is possible to sufficiently exhibit the characteristics of each toner. Hence, a desired color image can be surely obtained by transferring the toners to the paper 18 under the transfer conditions optimum for the respective toners.

Furthermore, like the second embodiment, for example, when the characteristics of the toners of the respective colors bear strong resemblance to each other or when quite margins are given in the transfer electric potential, etc., if all or most of the contents of the transfer control, such as the electric potential applied to each of the transfer rollers 16, are made identical, the transfer control can be simplified on the whole.

Besides, in the first to third embodiments, charge is supplied to the paper 18 from the transfer roller 16 by producing a predetermined potential difference between the transfer roller 16 and the photosensitive drum 7 by the transfer power supply 17, and the toner image on the photosensitive drum 7 is transferred to the paper 18 by Coulomb's force. Therefore, the transfer roller 16 and the paper 18 correspond to the charge supply device and the body to be charged recited in the claims.

Embodiment 4

Figure 16:
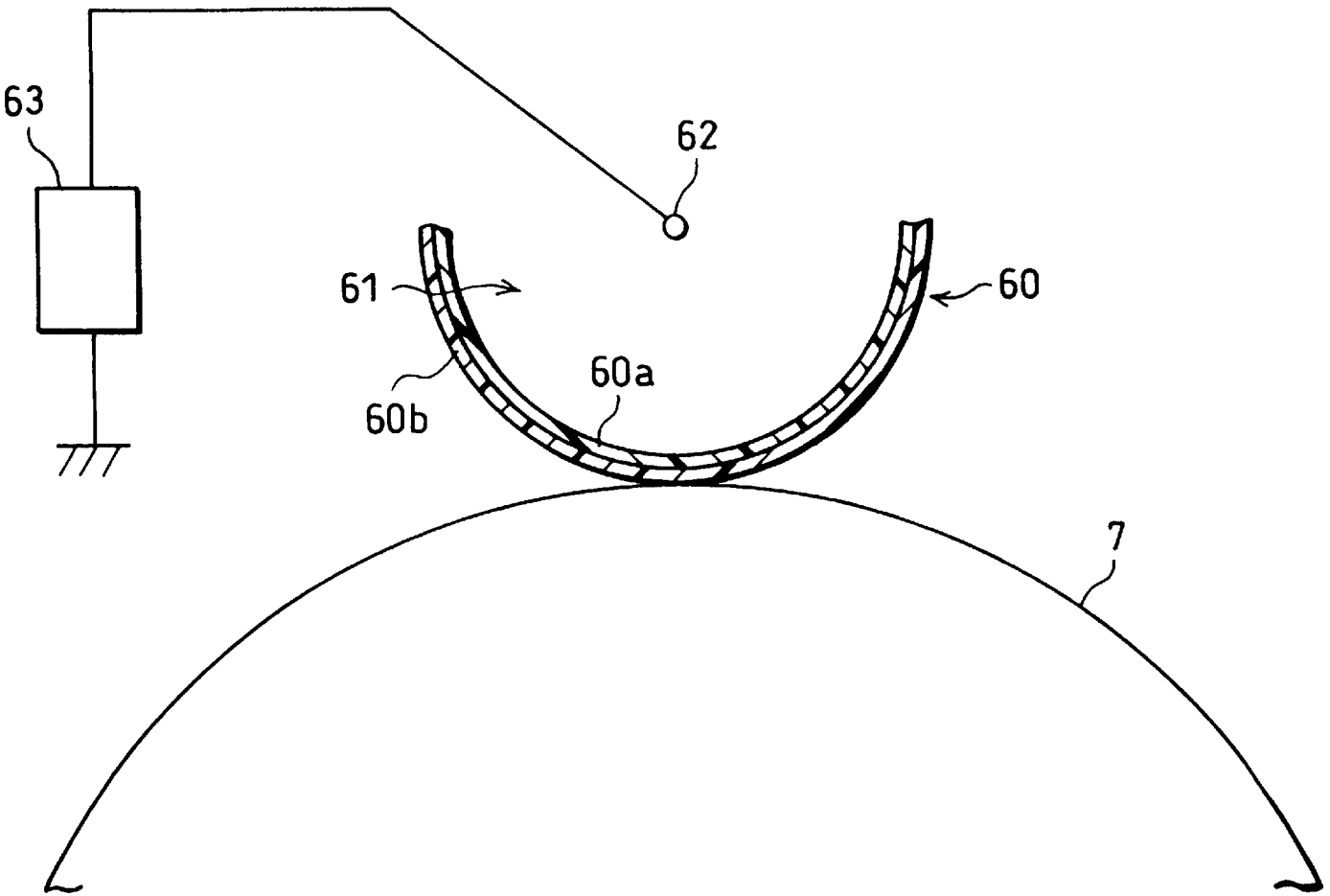
FIG. 16 is an explanatory view showing a schematic structure of a charging roller incorporated into an image forming apparatus according to yet another embodiment of the present invention.

The following description will explain yet another embodiment of the present invention with reference to FIG. 16. For the sake of simplifying the explanation, the members having the same functions as those in the first to third embodiments will be designated by the same codes and the explanation thereof will be omitted.

An image forming apparatus of this embodiment has the same structure as the image forming apparatus used in the first embodiment, except that the charging roller 8 of the first embodiment is replaced by a charging roller 60 shown in FIG. 16. The charging roller 60 is obtained by applying the structure of the transfer roller 16 of the first embodiment to the charging roller 8. The detailed explanation of the charging roller 60 will be given below.

The transfer roller 60 is disposed to face the photosensitive drum 7, and charges the surface of the photosensitive drum 7 by supplying charge to the photosensitive drum 7. Thus, the charging roller 60 corresponds to the charge supply device and the charging means recited in the claims. Meanwhile, the photosensitive drum 7 corresponds to the body to be charged, recited in the claims.

The charging roller 60 is produced by fixing an elastic layer 60*b* (elastic member), which comes into contract with the photosensitive drum 7, to the external surface of a base member 60 having a cylindrical shape. The base member 60*a* is a semiconductive member made of, for example, a silicone resin, carbon black having conductivity, etc, and has, a relative permittivity of, for example, around 20 to 30. Alternatively, the base member 60*a* may be formed by a material having an insulating property or medium resistance. The base member 60*a* is hollow, and closed. With this structure, a region 61 having a high resistance equal to the atmosphere is formed inside the base member 60*a*.

A discharge electrode 62 (discharging means) serving as the rotation axis of the charging roller 60 is provided in the region 61. The discharge electrode 62 discharges the inside of the charging roller 60 so that discharge occurs between the charging roller 60 and the photosensitive drum 7 and charge is supplied from the charging roller 60 to the surface of the photosensitive drum 7 by the discharge. The discharge electrode 62 is connected to a charging power supply 63 (power supply means) and is supplied with an electric potential of, for example, −2.8 kV by the charging power supply 63. This produces a predetermined potential difference between the charging roller 60 and the photosensitive drum 7, and causes discharge therebetween. The above-mentioned charging power supply 63 is grounded.

A gas such as neon and helium is sealed in the base member 60*a*, and thus discharge occurs easily between the discharge electrode 62 and the base member 60*a*. Furthermore, since the region 61 is maintained in a low pressure state, it is possible to certainly discharge the region between the photosensitive drum 7 and the charging roller 60.

Note that the inside of the base member 60*a* can be filled with a substance having a form, such as a liquid, having a high resistance equal to the atmosphere, instead of making the inside of the base member 60*a* hollow. Besides, the inside of the region 61 can be in a state having atmospheric pressure. Needless to say, it is possible to cause discharge even in such a case.

The elastic layer 60*b* is formed from, for example, urethane rubber or silicone rubber having a volume resistivity of $10^7$ Ω·cm and a shorter length in the direction of the rotation axis than the base member 60*a*. With the use of such an elastic layer 60*b*, the surface of the photosensitive drum 7 can be certainly charged by surely bringing the elastic layer 60*b* into contact with the photosensitive drum 7. Besides, even when the elastic layer 60*b* is not provided in view of the cost, life and reliability of the apparatus, the effects of this embodiment is obtainable.

A bearing section (not shown) for bearing a shaft (not shown) for pressing the charging roller 60 itself against the photosensitive drum 7 is provided at a portion of the surface of the base member 60*a*, which portion is not covered with the elastic layer 60*b*. For example, a 500-gram load is applied to both ends of the shaft so as to press the charging roller 60 against the photosensitive drum 7.

Figure 17:
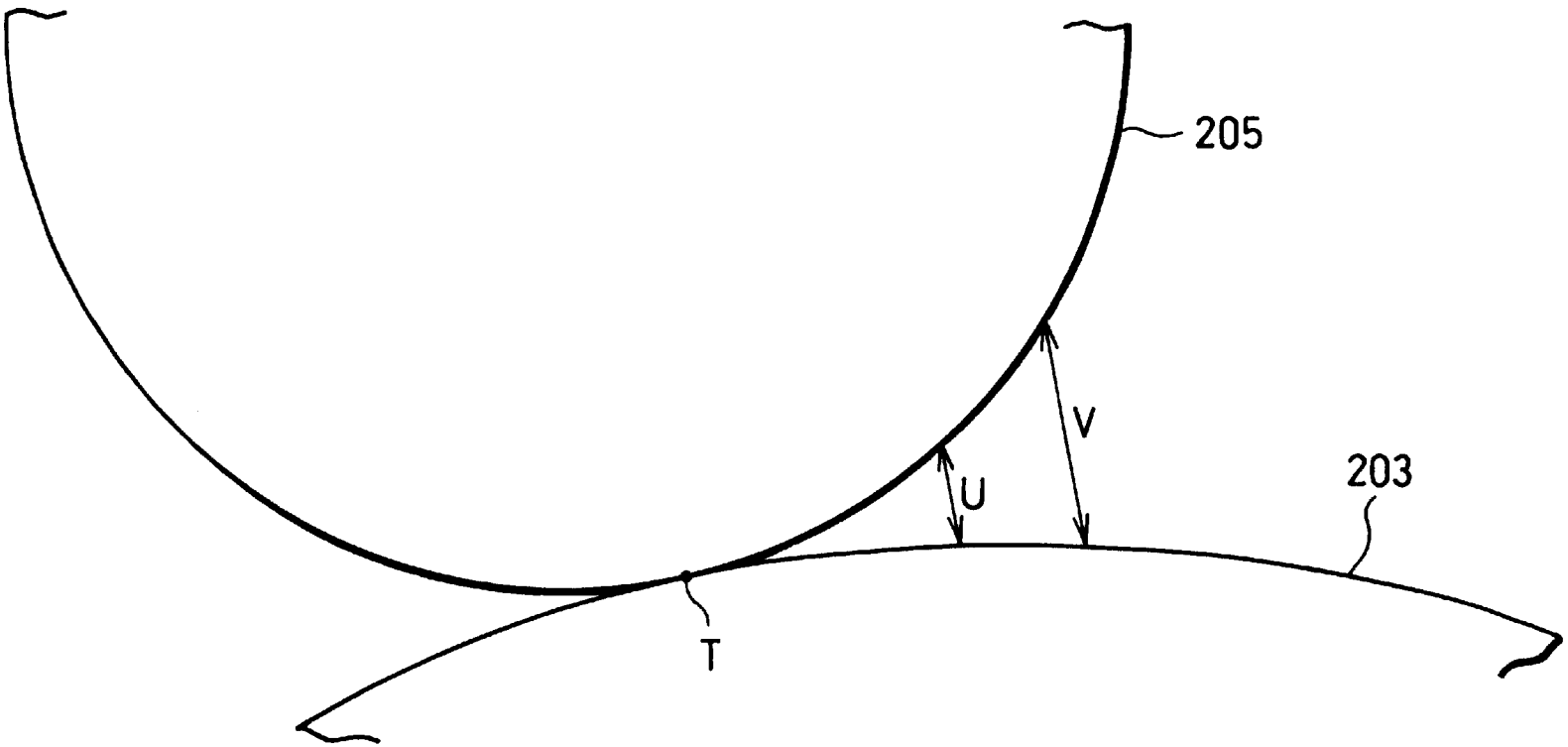
FIG. 17 is an explanatory view of a conventional image forming apparatus, showing a region where an electric field is formed by normal discharge and a region where an electric field is formed by the application of a high electric potential to the charging roller.

In this structure, when a charging electric potential of −2.8 kV is applied to the discharge electrode 62 by the charging power supply 63, the charging electric potential is separately applied to the region 61 and a region between the charging roller 60 and the photosensitive drum 7. Here, since the region 61 is a region of a high resistance equal to the atmosphere, an electric field can never be increased to a value higher than a necessary value in a region (region V in FIG. 17, which does not originally require formation of an electric field and is separated by a certain distance from the contact section between the charging roller 60 and the photosensitive drum 7) other than a usual discharge region (corresponding to region U in FIG. 17) in the vicinity of the above-mentioned contract region, because of the same principle as of the transfer roller 16. Therefore, discharge does not occur in the region V.

Here, the diameter of the discharge path between the charging roller 60 and the photosensitive drum 7 becomes smaller as the distance between the surface of the charging roller 60 and that of the photosensitive drum 7 increases. However, in the above-mentioned structure, since the discharge in the region V is avoided, it is possible to prevent a discharge with a discharge path of a small diameter.

On the other hand, in the region U, discharge is caused by the generation of a strong electric field due to the discharge in the region 61 inside the charging roller 60. At this time, since the discharge path in the region U is shorter than the discharge path in the region V, the diameter of the discharge path in the region U is greater than that in the region V.

Therefore, in the structure of this embodiment, it is possible to limit uneven charging in which the electric potential on the surface of the photosensitive drum 7 varies locally, and form an image of good quality by preventing a granular pattern from being formed in the printed image due to the uneven charging.

Various structures of the transfer roller 16 mentioned in the first embodiment are also applicable to the charging roller 60. Needless to say, the same effects as the effects produced by the use of the transfer roller 16 can be obtained by the application of the structures of the transfer roller 16 to the transfer roller 60. Additionally, it is also possible to apply the charging roller 60 to the color image forming apparatuses of the second and third embodiments. Furthermore, since the characteristic values and electric potentials of the above-mentioned respective members can be suitably set or changed depending on applications, it is possible to obtain uniform and good charging characteristics.

Additionally, in the above-mentioned respective embodiments, applications of the charge supply devices to the transfer roller 16 or the charging roller 60 are illustrated as examples. However, it is also possible to apply the charge supply device to, for example, an apparatus for charging an insulating film for use in a liquid crystal panel and/or for removing charge on the insulating film. Namely, the charge supply device of the present invention is applicable to apparatuses other than image forming apparatuses.

As described above, a charge supply device of the present invention, which is disposed to face a body to be charged and supplies charge to the body to be charged, may be arranged to include therein a high resistant region having a resistance equal to the atmosphere, and discharging means in the high resistant region, for forming an electric field capable of supplying charge to the body to be charged, between the charge supply device and the body to be charged, by generating charge by discharge.

Besides, an image forming apparatus of the present invention may include the above charge supply device.

With the above arrangement, since the charge supply device is provided, it is possible to form an appropriate electric field between the charge supply device and the body to be charged in a stable manner, thereby preventing a lowering of the quality of a formed image due to a variation of electric field.

Moreover, an image forming apparatus of the present invention, which includes an image carrier; charging means disposed to face the image carrier; and power supply means for producing a predetermined potential difference between the image carrier and the charging means, and which supplies charge to the image carrier from the charging means by causing discharge between the image carrier and the charging means by the potential difference, may be arranged so that the charging means includes therein a high resistant region having a high resistance equal to the atmosphere, and discharging means in the high resistant region, for forming an electric field capable of supplying charge to the image carrier, between the charging means and the image carrier, by causing the charging means to generate charge by discharge.

With this arrangement, discharge occurs between the charging means and the image carrier by producing a predetermined potential difference between the charging means and image carrier by the power supply means. As a result, charge is supplied from the charging means to the image carrier, and the surface of the image carrier is charged.

The potential difference produced between the charging means and the image carrier is separately produced in a region inside the charging means (hereinafter referred to as the first region) and a region between the charging means and image carrier (hereinafter referred to as the second region). Here, the high resistant region having a high resistance equal to the atmosphere is formed inside the charging means, and it corresponds to the first region. On the other hand, the second region is a region in the atmosphere, and is originally a high resistant region. Namely, in this arrangement, both of the first and second regions have similar high resistance, and there is no extreme difference in resistance between those regions.

Therefore, for instance, even if a high electric potential is applied to the charging means, fractions of the electric potential substantially proportional to the values of resistance are applied to the first and second regions, respectively. Consequently, the electric field can never be concentrated especially in the second region due to the difference in resistance between the first and second regions like a conventional structure. Hence, unlike a conventional structure, a high electric field can never be formed in a region between the charging means and image carrier, where the formation of an electric field is not originally required and the surfaces of the charging means and image carrier are separated by a certain distance, and a discharge can never occur in this region.

Here, the diameter of the discharge path between the charging means and the image carrier becomes smaller as the distance between the surfaces of the charging means and image carrier increases. However, in the above-mentioned arrangement, since a discharge in the region where the formation of an electric field is not originally required is avoided, it is possible to prevent a discharge with a discharge path of a small diameter.

Accordingly, the electric potential on the surface of the image carrier does not vary locally. It is thus possible to prevent a granular pattern from being formed in an printed image due to the uneven charging of the image carrier, and form an image of good quality.

Furthermore, an image forming apparatus of the present invention, which includes an image carrier for carrying a charge pattern corresponding to image information; developing means for developing the charge pattern into an image by developer, transfer means disposed to face the image carrier; and power supply means for producing a predetermined potential difference between the image carrier and the transfer means, and which transfers the image on the image carrier to a recording medium supplied between the image carrier and the transfer means by the potential difference, may be arranged so that the transfer means includes therein a high resistant region having a high resistance equal to the atmosphere, and discharging means in the high resistant region, for forming a transfer electric field between the image carrier and transfer means by causing the transfer means to generate charge by discharge.

With this arrangement, the charge pattern formed on the image carrier is developed into a visible image by the developing means. When a predetermined electric potential is applied to the transfer means from the power supply means, a potential difference is produced between the image carrier and the transfer means, thereby transferring the visible image to the recording medium supplied between the image carrier and transfer means.

The electric potential supplied to the transfer means from the power supply means is applied separately to a region inside the transfer means (hereinafter referred to as the first region) and a region between the transfer means and image carrier (hereinafter referred to as the second region). Here, a high resistant region having a high resistance equal to the atmosphere is formed inside the transfer means, and it corresponds to the first region. On the other hand, the second region is a region in the atmosphere, and is originally a high resistant region. Namely, in this arrangement, both of the first and second regions have similar high resistance, and there is no extreme difference in resistance between those regions.

Therefore, for instance, even when a high electric potential is applied to the transfer means by performing image formation at a high speed, since fractions of the electric potential substantially proportional to the values of resistance are applied to the first and second regions, respectively, the electric field can never be concentrated in especially the second region due to the difference in resistance between the first and second regions like a conventional structure.

Hence, with the above arrangement, it is possible to prevent the developer carried on the image carrier from unpreparedly flying to the transfer means in the second region when a high electric potential is applied to the transfer means. As a result, for example, when performing image formation at a high speed, it is possible to avoid blurring of the outline of the transferred image and a lowering of the contrast, thereby providing a good transferred image.

Meanwhile, in the conventional structure, the transfer electric field is concentrated in particularly the second region when a high electric potential is applied to the transfer means. Therefore, for example, if a recording medium of a small width is used, the transfer electric field and the transfer current are likely to be concentrated in the region where the recording medium is not present and the image carrier and the transfer means are in contact with each other. However, in the above-mentioned arrangement, even when a high electric potential is applied to the transfer means, the transfer electric field and transfer current can never be concentrated in the contact region.

Thus, the above arrangement can prevent a shortage of the transfer current supplied for the transfer of the developer to the recording medium, and achieve a good transfer even when a recording paper of a small width is used. Additionally, in such a case, since there is no need to use a large-scale power supply means to avoid the shortage of the transfer current nor transfer means of a high resistance, it is possible to prevent an increase in the cost of the apparatus and reduce the size of the apparatus.

Furthermore, in the image forming apparatus of the present invention, the high resistant region may be a space maintained in a state with a pressure lower than the atmospheric pressure.

With this arrangement, under the state with low pressure, a discharge maintaining voltage for maintaining the discharge can be a low voltage. Moreover, since a discharge having spark is less likely to occur compared with the atmospheric discharge, and therefore the discharge inside the transfer means or charging means is further stabilized. Thus, since charge for forming the transfer electric field can be generated in a stable manner by the stable discharge inside the transfer means, it is possible to significantly improve the transfer performance in the nip region (the region where the image carrier is pressed against the transfer means) compared with the arrangement adopting the atmospheric discharge. In addition, the charging characteristics can be significantly improved by the stable discharge inside the charging means.

Moreover, the image forming apparatus of the present invention may be arranged so that the transfer means includes an elastic member capable of pressing the recording medium against the image carrier.

With this arrangement, since the elastic member presses the recording medium against the image carrier uniformly with a predetermined transfer pressure, it is possible to obtain good transfer characteristics. As a result, good image formation can be performed.

Furthermore, the image forming apparatus of the present invention may be arranged so that a conductive member is formed in a section facing the discharging means, inside the transfer means.

With this arrangement, discharge between the discharging means and the conductive member is facilitated, and the discharge is further stabilized. Consequently, a stable, uniform electric field can be certainly formed between the image carrier and the transfer means, thereby achieving further improved image formation.

In addition, the image forming apparatus of the present invention may be arranged so that the transfer means is rotatable, and the conductive member is divided into a plurality of pieces perpendicularly to the rotation axis of the transfer means placed along a cross direction of the recording medium.

This arrangement can restrict a flow of the charge generated on the surface of the transfer means by the discharge inside the transfer means, in a direction parallel to the rotation axis of the transfer means. Therefore, for instance, when a recording medium of a small width is used, it is possible to prevent the transfer current from flowing to a portion where the recording paper is not present from a portion where the recording paper is present. It is thus possible to certainly prevent a shortage of the transfer current supplied for the transfer of the developer to the recording medium, and achieve a further improved transfer with respect to the recording paper of any width.

Besides, the image forming apparatus of the present invention may be arranged so that the transfer means is rotatable, and the conductive member is divided into a plurality of pieces parallel to the rotation axis of the transfer means, placed along a cross direction of the recording paper.

This arrangement can restrict a flow of the charge generated on the surface of the transfer means by the discharge inside the transfer means, in a rotating direction of the transfer means. It is therefore possible to prevent the transfer current from flowing into a portion where the recording paper is not present from a portion where the recording paper is present, in a transport direction perpendicular to the cross direction of the recording paper. It is thus possible to certainly prevent such a problem that the electric field is concentrated in regions where the recording medium is not present in the vicinity of the leading end and trailing end of the recording medium, thereby certainly avoiding deterioration of the image in the vicinity of the leading end and trailing end of the recording medium.

Furthermore, the image forming apparatus of the present invention may be arranged to include charge removing means for removing charge on the surface of the transfer means.

With this arrangement, since the charge remaining on the surface of the transfer means is neutralized and removed by the charge removing means, a transfer electric field disorder is not caused by the remaining charge. Thus, a uniform transfer electric field can be always formed, and good transfer characteristics can be obtained.

In addition, for example, if the transfer means includes an elastic member to be pressed against the image carrier and this elastic member has a high resistance, the charge is likely to accumulate particularly on the elastic member when a high electric potential is applied to the transfer means. As a result, a desired transfer electric field may not be obtained. However, even in such a case, since the charge accumulated on the surface of the elastic member is certainly removed by the charge removing means, it is possible to prevent a transfer electric field disorder resulting from an increase in the amount of charge and to avoid deterioration of the image quality.

Additionally, the image forming apparatus of the present invention may be arranged so that the charging means includes an elastic member to be pressed against the image carrier.

With this arrangement, since the charging means and the image carrier are pressed uniformly against each other with a predetermined pressure by the elastic member, the supply of charge from the charging means to the image carrier can be performed satisfactorily.

Moreover, the image forming apparatus of the present invention may be arranged so that a conductive member is formed in a section facing the discharging means, inside the charging means.

With this arrangement, the discharge between the discharging means and conductive member is facilitated, and the discharge is further stabilized. It is thus possible to form certainly a stable, uniform electric field between the charging means and the image carrier.

Furthermore, the image forming apparatus of the present invention may be arranged so that the charging means is rotatable, and the conductive member is divided into a plurality of pieces perpendicularly to the rotation axis of the charging means.

This arrangement can restrict a flow of the charge generated on the surface of the charging means because of the discharge inside the charging means, in a direction parallel to the rotation axis of the charging means. It is thus possible to uniformly charge the surface of the image carrier.

Besides, the image forming apparatus of the present invention may be arranged so that the charging means is rotatable, and the conductive member is divided into a plurality of pieces parallel to the rotation axis of the charging means.

This arrangement can restrict a flow of the charge generated on the surface of the charging means because of the discharge inside the charging means, in a rotating direction of the charging means. It is therefore possible to uniformly charge the surface of the image carrier.

Additionally, the image forming apparatus of the present invention may be arranged to further include charge removing means for removing the charge on the surface of the charging means.

With this arrangement, since the charge remaining on the surface of the charging means is neutralized and removed by the charge removing means, an electric field disorder is not caused by the remaining charge. Thus, a uniform electric field can be always formed.

In addition, the image forming apparatus of the present invention may be arranged so that the elastic member has such electric characteristics that removal of the charge on the elastic member is not required.

With this arrangement, since the charge removing means for removing the charge on the surface of the elastic member does not need to be installed additionally, the number of parts and the size of the image forming apparatus can be reduced, and the increase in the cost of the image forming apparatus can be avoided. Moreover, in this case, since the elastic member has such electric characteristics that the removal of charge is not required, the increase in the amount of charge on the elastic member is prevented. Therefore, a transfer electric field disorder or charging electric field disorder because of the increase in the amount of charge is avoided. Hence, this structure can always form a uniform transfer electric field or charging electric field without installing the charge removing means, and improve the reliability of the image forming apparatus.

Besides, the image forming apparatus of the present invention may be arranged so that the elastic member has a volume resistivity between $10^5$ Ω·cm and $10^{14}$ Ω·cm.

With this arrangement, when the volume resistivity of the elastic member is less than $10^5$ Ω·cm, relaxation is difficult when a local low resistant portion is produced. Therefore, when the elastic member is applied to the transfer means, the transfer electric field is likely to be concentrated in a region between the elastic member and image carrier, where the recording medium is not present. Meanwhile, when the elastic member is applied to the charging means, it can not cope with the increase in the current caused by, for example, a pinhole produced in the image carrier, and an excessive current is generated. As a result, a sufficient electric potential may not be supplied, and charging defects may occur. On the other hand, when the volume resistivity of the elastic member is more than $10^{14}$ Ω·cm, it is hard to neutralize the charge on the surface and inside the elastic member, and therefore the amount of charge on the surface increases.

Thus, by arranging the volume resistivity of the elastic member to be between $10^5$ Ω·cm and $10^{14}$ Ω·cm, it is possible to prevent certainly the concentration of the transfer electric field in the region where the recording medium is not present, the occurrence of charging defects, and the increase in the amount of charge on the surface of the elastic member.

Moreover, the image forming apparatus of the present invention may be arranged so that the power supply means applies a voltage having a frequency component to the discharging means.

With this arrangement, compared with a structure where a DC electric potential is applied to the discharging means, the discharge inside the transfer means or charging means is carried out in more stable manner. As a result, since more uniform transfer electric field or charging electric field is formed, better transfer characteristics or charging characteristics can be obtained, thereby achieving further improved image formation.

Besides, the image forming apparatus of the present invention, which includes: a plurality of image forming sections having at least image carriers for carrying charge patterns corresponding to predetermined colors of image information, respectively, and developing means for developing the charge patterns into images by developers corresponding to the predetermined colors; a plurality of transfer means disposed to face the image carriers, respectively; and power supply means for producing predetermined potential differences between the respective image carriers and transfer means, and which transfers images on the image carriers to a recording medium supplied between the image carriers and the transfer means, is arranged so that each of the transfer means includes therein a high resistant region having a high resistance equal to the atmosphere, and discharging means in the high resistant region, for forming a transfer electric field between the image carrier and the transfer means by generating charge on the transfer means by discharge.

According to this arrangement, in each of the image forming sections, the charge pattern formed on the image carrier is developed into a visible image by the developing means. When a predetermined electric potential is applied to the transfer means facing the image carrier by the power supply means, a potential difference between the image carrier and transfer means is produced, and therefore the visible image is transferred to the recording medium supplied between the image carrier and the transfer means. Such a transfer is performed in each of the image forming sections. As a result, a color image is formed on the recording medium.

The electric potential supplied to the transfer means from the power supply means is applied separately to a region inside the transfer means (hereinafter referred to as the first region) and a region between the transfer means and image carrier (hereinafter referred to as the second region). Here, a high resistant region having a high resistance equal to the atmosphere is formed inside the transfer means, and this high resistant region corresponds to the first region. On the other hand, the second region is a region in the atmosphere, and is originally a high resistant region. Namely, in this arrangement, both of the first and second regions have similar high resistance, and there is no extreme difference in the values of resistance between those regions.

Therefore, even if a high electric potential is applied to a predetermined transfer means by, for example, performing image formation at a high speed, fractions of the electric potential substantially proportional to the values of resistance are applied to the first and second regions, respectively. Therefore, the electric field can never be concentrated in especially the second region like a conventional structure.

Moreover, in the conventional structure, the electric field is concentrated especially in the second region when a high electric field is applied to the transfer means. Therefore, for example, if a recording medium of a small width is used, the transfer electric field and transfer current are likely to be concentrated in a region where the recording paper is not present and the image carrier and transfer means are in contact with each other. However, with the above-mentioned arrangement, as described above, even when a high electric potential is applied, an electric potential in the second region can never increase to a value higher than a necessary value. Thus, the transfer electric field and transfer current are not concentrated in the contact region.

Hence, by using the transfer means of the present invention in a color image forming apparatus having a plurality of image forming sections and a plurality of transfer means corresponding to the respective image forming sections, the effects of the present invention can be obtained.

Besides, the image forming apparatus of the present invention may be arranged so that the plurality of transfer means correspond to the characteristics of the developers, respectively.

With this arrangement, by varying the structure of each transfer means according to the characteristic of the corresponding developer whose characteristics (charging ability, transferability to the recording medium, fixing ability, etc.) vary depending on each color of developer, the developer can be transferred to the recording medium under the conditions optimum for the characteristics of each developer, without deteriorating the characteristics of the developer. As a result, a color image with clear color tone can be certainly obtained.

Moreover, the image forming apparatus of the present invention may be arranged so that the transfers performed by the respective transfer means are controlled according to the characteristics of the corresponding developers.

With this arrangement, since the characteristics of the respective developers vary depending on colors, the developers can be transferred to the recording medium under optimum conditions corresponding to the characteristics of the respective developers without deteriorating the characteristics of the developers by controlling the transfers by, for example, changing the electric potential applied to each transfer means, according to the characteristics of each developer. As a result, a color image with clear color tone can be certainly obtained.

Furthermore, the image forming apparatus of the present invention may be arranged so that the respective transfer means are identical at least in a part of their structures.

With this arrangement, since at least a part of the structures of the respective transfer means is identical, the total number of component parts of the transfer means can be reduced. It is thus possible to limit the increase in the costs of the transfer means, and in turn the cost of the image forming apparatus.

In addition, the image forming apparatus of the present invention may be arranged so that the transfer controls of the respective transfer means are identical at least in a part of the contents.

With this arrangement, since at least a part of the contents of the transfer controls of the respective transfer means is identical, the transfer controls can be simplified on the whole.

Besides, the image forming apparatus of the present invention, which includes an image carrier for carrying a charge pattern corresponding to a predetermined color of image information; a plurality of developing means for developing the charge pattern by a developer corresponding to the colors, transfer means disposed to face the image carrier; and power supply means for producing a predetermined potential difference between the image carrier and the transfer means, and which transfers the image on the image carrier to a recording medium supplied between the image carrier and the transfer means by the potential difference, may be arranged so that the transfer means includes therein a high resistant region having a high resistance equal to the atmosphere, and discharging means in the high resistant region, for forming a transfer electric field between the image carrier and transfer means by causing the transfer means to generate charge by discharge.

With this arrangement, the charge pattern corresponding to the predetermined color is formed on the image carrier, and developed into a visible image by the corresponding developing means. When a predetermined electric potential is applied to the transfer means facing the image carrier from the power supply means, a potential difference between the image carrier and the transfer means is produced, thereby transferring the visible image to the recording medium supplied between the image carrier and transfer means. By performing the formation of the charged pattern on the image carrier, development, and transfer of the visible image to the recording medium from the image carrier for each color, a color image is finally formed on the recording medium.

The electric potential supplied to the transfer means from the power supply means is applied separately to a region inside the transfer means (hereinafter referred to as the first region) and a region between the transfer means and image carrier (hereinafter referred to as the second region). Here, a high resistant region having a high resistance equal to the atmosphere is formed inside the transfer means, and it corresponds to the first region. On the other hand, the second region is a region in the atmosphere, and is originally a high resistant region. Namely, in this arrangement, both of the first and second regions have similar high resistance, and thus there is no extreme difference in resistance between those regions.

Therefore, even when a high electric potential is applied to the transfer means by, for example, performing image formation at a high speed, since fractions of the electric potential substantially proportional to the values of resistance are applied to the first and second regions, respectively, the electric field can never be concentrated in especially the second region like a conventional structure.

Besides, in the conventional structure, the transfer electric field is concentrated in particularly the second region when a high electric potential is applied to the transfer means. Therefore, when, for example, a recording medium of a small width is used, the transfer electric field and the transfer current are likely to be concentrated in the region where the recording medium is not present and the image carrier and the transfer means are in contact with each other. However, in the above-mentioned structure, as described above, even when a high electric potential is applied to the transfer means, the electric potential in the second region can never increase to a value higher than a necessary value. Therefore, the transfer electric field and transfer current are not concentrated in the contact region.

Hence, even when the color image forming apparatus is constructed by using a plurality of developing means for developing images with developers corresponding to respective colors, the effects of the present invention can be obtained with the use of the transfer means of the present invention.

In addition, the image forming apparatus of the present invention may be arranged so that each transfer performed by the transfer means is controlled according to the characteristics of the corresponding developers.

With this arrangement, since the characteristics of the respective developers vary depending on colors, the developers can be transferred to the recording medium under optimum conditions for the characteristics of the respective developers without deteriorating the characteristics of the developers by controlling the transfers by, for example, changing the electric potential applied to the transfer means, according to the characteristics of each developer. As a result, a color image with clear color tone can be certainly obtained.

Furthermore, the image forming apparatus of the present invention may be arranged so that the contents of transfer controls performed for respective colors by the transfer means are identical at least in a part.

With this arrangement, since at least a part of the contents of the transfer controls of the transfer means is identical, the transfer controls can be simplified on the whole.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A charge supply device for supplying charge to a body to be charged, the charge supply device being adapted to be placed so as to face the body to be charged, and comprising:

a closed base member including therein a high resistance region having a resistance at least equal to that of the atmosphere;

discharge means, disposed in the high resistance region, for generating charge by discharge, and for forming, between the charge supply device and the body to be charged, an electric field capable of supplying a desired charge to the body to be charged; and a conductive member disposed in a section inside the base member, the conductive member being located in non-contacting relationship with, and facing, the discharge means.

2. The charge supply device as set forth in claim 1, wherein the high resistant region is a space maintained in a state with a pressure lower than atmospheric pressure.

3. The charge supply device as set forth in claim 1, further comprising an elastic member to be pressed against the body to be charged.

4. The charge supply device as set forth in claim 3, wherein the elastic member has such an electric characteristic that the elastic member does not require removal of charge.

5. The charge supply device as set forth in claim 4, wherein the elastic member has a volume resistivity in a range of $10^5$ to $10^{14}$ Ω·cm.

6. The charge supply device as set forth in claim 1, wherein the base member is rotatable, and the conductive member is divided into a plurality of pieces perpendicularly to a rotational axis of the base member.

7. The charge supply device as set forth in claim 1, wherein the base member is rotatable, and the conductive member is divided into a plurality of pieces parallel to a rotational axis of the base member.

8. The charge supply device as set forth in claim 1, wherein the base member is rotatable, and the conductive member is divided into a plurality of pieces perpendicularly to the rotational axis of the base member and also divided into a plurality of pieces parallel to the rotational axis.

9. The charge supply device as set forth in claim 1, further comprising charge removing means for removing charge on the surface of the base member.

10. The charge supply device as set forth in claim 1, further comprising power supply means for applying a voltage having a frequency component to the discharging means.

11. An image forming apparatus comprising the charge supply device set forth in claim 1.

12. An image forming apparatus comprising:

an image carrier;

charging means disposed to face the image carrier; and power supply means for producing a predetermined potential difference between the image carrier and the charging means, wherein charge is supplied from the charging means to the image carrier by discharge between the image carrier and the charging means caused by the potential difference, and the charging means is constituted by the charge supply device set forth in claim 1.

13. An image forming apparatus comprising:

an image carrier for carrying a charge pattern corresponding to image information;

developing means for developing the charge pattern into a visible image by developer;

transfer means disposed to face the image carrier; and power supply means for producing a predetermined potential difference between the image carrier and the transfer means, wherein the image on the image carrier is transferred to a recording medium supplied between the image carrier and the transfer means by the potential difference, and the transfer means is constituted by the charge supply device set forth in claim 1.

14. An image forming apparatus comprising:

a plurality of image forming sections, each of the image forming sections including an image carrier for carrying a charge pattern corresponding to color information contained in image information and developing means for developing the charge pattern into an image by developer corresponding to the color information;

a plurality of transfer means disposed to face the image carriers, respectively; and power supply means for producing a predetermined potential difference between the image carriers and transfer means, wherein the image on each of the image carriers is transferred to a recording medium supplied between the image carrier and the transfer means by the potential difference, and each of the transfer means is constituted by the charge supply device set forth in claim 1.

15. The image forming apparatus as set forth in claim 14, wherein each of the transfer means is constructed according to characteristics of each developer.

16. The image forming apparatus as set forth in claim 14, wherein each of the transfer means comprises an elastic member to be pressed against the corresponding image carrier, and a thicknesses of each elastic member varies according to each image forming section.

17. The image forming apparatus as set forth in claim 14, wherein a transfer performed by each of the transfer means is controlled according to characteristics of each developer.

18. The image forming apparatus as set forth in claim 14, wherein the power supply means produces a potential difference between each of the image carriers and transfer means, the potential difference varying according to each image forming section.

19. The image forming apparatus as set forth in claim 14, wherein the respective transfer means are identical at least in a part of their structures.

20. The image forming apparatus as set forth in claim 14, wherein transfer controls performed by the respective transfer means are identical in at least a part of their contents.

21. An image forming apparatus comprising:

an image carrier for carrying a charge pattern corresponding to color information contained in image information;

a plurality of developing means for developing the charge pattern into an image by developer corresponding to the color information;

transfer means disposed to face the image carrier; and power supply means for producing a predetermined potential difference between the image carrier and the transfer means, wherein the image on the image carrier is transferred to a recording medium supplied between the image carrier and the transfer means by the potential difference, and the transfer means is constituted by the charge supply device set forth in claim 1.

22. The image forming apparatus as set forth in claim 21, wherein a transfer performed by the transfer means is controlled according to characteristic of each developer.

23. The image forming apparatus as set forth in claim 21, wherein the power supply means produces a potential difference between the image carrier and the transfer means according to characteristics of the developer.

24. The image forming apparatus as set forth in claim 21, wherein transfer controls performed for respective colors by the transfer means are identical in at least a part of their contents.

25. A charge supply device for supplying charge to a body to be charged, the charge supply device being adapted to be placed so as to face the body to be charged, and comprising:

a closed and rotatable base member having a rotational axis, and including therein a high resistance region having a resistance at least equal to that of the atmosphere;

discharge means, disposed in said high resistance region, for generating charge by discharge, and for forming, between the charge supply device and the body to be charged, an electric field capable of supplying a desired charge to the body to be charged; and a conductive member divided into a plurality of pieces perpendicularly to the rotational axis of the base member, said conductive member being disposed in a section inside the base member in non-contacting relationship with, and facing, said discharge means.

26. The charge supply device as set forth in claim 25, wherein the conductive member is divided into a plurality of pieces parallel to a rotational axis of the base member.

27. The charge supply device as set forth in claim 25, wherein the conductive member is divided into a plurality of pieces perpendicularly to the rotational axis of the base member and also divided into a plurality of pieces parallel to the rotational axis.

28. An image forming apparatus comprising:

a plurality of image forming sections, each of the image forming sections including an image carrier for carrying a charge pattern corresponding to color information contained in image information and developing means for developing the charge pattern into an image by developer corresponding to the color information;

a plurality of transfer means disposed to face the image carriers, respectively; and power supply means for producing a predetermined potential difference between the image carriers and the transfer means, wherein the image on each of the image carriers is transferred to a recording medium supplied between the image carrier and the transfer means by the potential difference, and each of the transfer means is constituted by a charge supply device for supplying charge to a body to be charged, the charge supply device being placed to face the body to be charged, and comprising:

a closed base member including therein a high resistance region having a resistance equal to atmosphere; and discharge means, disposed in the high resistance region, for generating charge by discharge, and for forming, between the charge supply device and the body to be charged, an electric field capable of supplying the charge to the body to be charged; and each of the transfer means further comprises an elastic member adapted to be pressed against the corresponding image carrier, a thickness of each elastic member varying according to each image forming section.

* * * * *